US006628090B1

(12) United States Patent
Scollo

(10) Patent No.: US 6,628,090 B1
(45) Date of Patent: Sep. 30, 2003

(54) RESONANT DRIVING SYSTEM FOR A FLUORESCENT LAMP

(75) Inventor: Rosario Scollo, Misterbianco (IT)

(73) Assignee: STMicroelectronics, S.r.l., Agrate Brianza (IT)

( * ) Notice: Subject to any disclaimer, the term of this patent is extended or adjusted under 35 U.S.C. 154(b) by 0 days.

(21) Appl. No.: 10/161,060

(22) Filed: May 31, 2002

(51) Int. Cl.[7] ..... H05B 37/02

(52) U.S. Cl. ..... 315/224; 315/209 R; 315/276; 315/291; 315/DIG. 5

(58) Field of Search ..... 315/224, 209 R, 315/219, 225, 200 R, 246, 274, 276–279, 291, DIG. 2, DIG. 4, DIG. 7

(56) References Cited

U.S. PATENT DOCUMENTS 5,349,270 A * 9/1994 Roll et al. ..... 315/209 R
5,864,211 A * 1/1999 Kiermeier ..... 315/127
5,917,289 A 6/1999 Nerone et al. ..... 315/209 R
5,925,984 A * 7/1999 Fischer et al. ..... 315/219
5,962,985 A * 10/1999 Buij et al. ..... 315/224
5,965,985 A 10/1999 Nerone ..... 315/DIG. 4
5,982,108 A * 11/1999 Buij et al. ..... 315/209 R
6,018,220 A 1/2000 Nerone ..... 315/219

* cited by examiner

*Primary Examiner*—Don Wong
*Assistant Examiner*—Tuyet T. Vo
(74) *Attorney, Agent, or Firm*—Graybeal Jackson Haley LLP

(57) ABSTRACT

A resonant driving system for a fluorescent lamp having one end connected to a primary winding of a transformer. The driving system includes an inductor inserted between an input section of the resonant driving system and an internal circuit node that is connected to another end of the fluorescent lamp a converter inserted between the internal node and a voltage reference and comprising a first transistor and a second transistor of the complementary type, inserted, in series to each other, between the internal node and the voltage reference, and a control circuit connected to a secondary winding of the transformer and to the converter as well as to the control terminals of the first and second transistors of the converter, wherein the control circuit comprises an inductor connected to a resistor that is connected to the control terminals of the first and second transistors through a first and a second capacitor respectively.

29 Claims, 12 Drawing Sheets

RESONANT DRIVING SYSTEM FOR A FLUORESCENT LAMP

TECHNICAL FIELD

This invention relates generally, but not exclusively, to a resonant driving system for a fluorescent lamp having at least one end connected to a primary winding of a transformer.

The invention is particularly, but not exclusively, directed to a resonant driving system for a fluorescent lamp having at least one end connected to a primary winding of a transformer. The system includes an inductor inserted between an input section of the system and an internal circuit node, a converter inserted between the internal node and a voltage reference and comprising a first transistor and a second transistor of the complementary type, inserted, in series to each other, between the internal node and the voltage reference, and a control circuit connected to a secondary winding of the transformer and to the converter as well as to the control terminals of the first and second transistors of the converter.

BACKGROUND OF THE INVENTION

As is well known, fluorescent lamps are generally made with a tube filled with a mercury-based gas mixture at low pressure. The inner side of the tube is covered by phosphorus or other similar fluorescent elements. When a lamp is turned on, its two electrodes starts to warm up and to emit ions that contribute to fully ionize the gas mixture inside the lamp, facilitating the strike of the arc across the two electrodes.

From an electrical point of view, the resistance of the lamp falls from about one mega ohm down to few hundreds ohm as illustrated in FIG. 1 by the I–V characteristic of a typical low pressure fluorescent lamp at the start up of the lamp.

Once the arc is established, the mercury gas emits radiation in the ultraviolet spectrum that excites the phosphorous coating of the inner side of the lamp. At this time the phosphorous starts to fluoresce producing the light in the visible spectrum.

It should be noted that fluorescent lamps usually require about 600V as peak voltage to strike the arc. Once the arc is established about 100V is enough to sustain it.

In order to avoid the so-called cataphoresis effect, the fluorescent lamps are usually supplied with sinusoidal waveforms by means of an inductor, usually indicated as the ballast. The ballast is connected to a DC-to-AC converter. A capacitive filter is also included to further remove any DC components of the relevant waveforms.

From the I–V characteristic shown in FIG. 1 it is also evident that the voltage across a fluorescent lamp is never equal to the main voltage. In particular, at the start up such a voltage is much higher than the main voltage, and while in steady state it is quite lower. Consequently, the ballast has the important function of generating the high voltage needed to strike the arc and after to generate the inductive reactance needed to reduce the voltage across the electrodes of the lamp. Furthermore the value of inductance L of the ballast must be chosen so that it does not saturate when the lamp is in its operation voltage condition, even at high temperatures.

However, it should be noted that the I–V characteristic shown in FIG. 1 is valid only at the lamp start up. Moreover, the shown characteristic is valid for any traditional magnetic ballasts working at a main frequency. In particular, the negative slope in the characteristic occurs at every cycle near the current zero crossing and it is due to the gas de-ionization. This causes a visible 50 Hz or 60 Hz flicker effect that can be eliminated by increasing the switching frequency of the lamp about three orders of magnitude. In fact at frequencies higher than 20 kHz there is no time for the de-ionization of the gas, and the I–V characteristic of the lamp is linear, as shown in FIG. 2.

The use of a higher frequency also provides two other important benefits: the power consumption is lowered, typically by about 70% due to the no deionization of the gas, with consequent longer life time of the fluorescent lamp;

a smaller inductor in series with the fluorescent lamp can be used, with consequent reduction in the weight of the fluorescent-lamp system.

A simplified block schematic diagram of a system 1 comprising a fluorescent lamp connected to a ballast according to a voltage fed topology is shown in FIG. 3. In particular, the system 1 has a first IN1 and a second input terminals IN2, connected to a main voltage supply and to a filtering block 2. The filtering block 2 in turn comprises a bridge circuit connected to the main supply and a filter, in turn connected to a conversion block 3.

The conversion block 3 substantially comprises a DC to AC converter and is connected to a tube 4 of the fluorescent lamp. In particular, the tube 4 has a first end connected to the conversion block 3 by means of a series of an inductor L (the ballast) and a first capacitor C1 and a second end directly connected to the conversion block 3.

Finally, the tube 4 has a second capacitor C2 connected in parallel to its ends.

According to the topology of the system 1 for fluorescent lamps shown in FIG. 3, the tube 4 is fed by generating an over voltage across the second capacitor C2 through the circuit formed by the series of the inductor L, the first capacitor C1 and the second capacitor C2 itself. At the start up, the system 1 is an open circuit and, by using a second capacitor C2 which is much smaller than the first capacitor C1, such a second capacitor C2 imposes the resonant frequency of the system 1. In such a way, the generated over voltage is high enough to ionize almost instantaneously the gas in the tube 4 of the fluorescent lamp. Once the fluorescent lamp is on, the second capacitor C2 will be short circuited by the fluorescent lamp itself and the natural frequency of the system 1 will be mainly determined by the first capacitor C1. So, the working frequency of the system 1 will be higher than this natural frequency and determined by the DC-AC converter 3.

From all the above, it is evident that core of the system 1 is the DC-to-AC converter 3. In order to clarify the operation of such a DC-to-AC converter 3 reference will be made to FIG. 4, which shows the system 1 of FIG. 3 in a greater detail.

It should be noted that the first capacitor C1 shown in FIG. 3 has been substituted by the two capacitors C5 and C6 (with identical capacitance) to better balance the system 1 as a whole.

In particular, the filtering block 2 of the system 1 comprises a filter 5 connected between the first IN1 and second input terminals IN2 as well as to a diode bridge circuit 6 in turn connected to the conversion block 3.

Moreover, the conversion block 3 has a first IN3 and a second input terminal IN4 and comprises a first resistor R and a third capacitor C3 connected in series between such input terminals IN3 and IN4. The interconnecting node between the first resistor R and the third capacitor C3 is connected to the control terminals of a first Q1 and a second transistor Q2, respectively by means of a series of a diode D0 and a second resistor R0 and by means of a diac D.

In the example shown in FIG. 4, the transistors Q1 and Q2 are bipolar transistors and their control terminals are the base terminals. In particular, the transistors Q1 and Q2 are both of the NPN type, the emitter terminal of the first transistor Q1 and the collector terminal of the second transistor Q2 being connected to an internal node X.

More particularly, the series of the diode D0 and the second resistor R0 is connected to the control terminal of the first transistor Q1 through a first winding of a transformer T and a third resistor R3, while the diac D is connected to the control terminal of the second transistor Q2 through a fourth resistor R4 and to a voltage reference, for instance a ground GND, through a second winding of the transformer T.

The first transistor Q1 is connected to the first input terminal IN3 of the conversion block 3 and to the internal node X by means of a fifth resistor R5. Moreover, a fourth capacitor C4 is connected between the conduction terminals of the first transistor Q1.

The second transistor Q2 is also connected to the internal node X and to the ground GND by means of a sixth resistor R6.

The conversion block 3 also comprises a third winding of the transformer T inserted, in series with an inductor L1, between the internal node X and one end of the tube 4 of the fluorescent lamp.

Finally, the system 1 comprises an electrolithic capacitor C7 connected in parallel to the filtering block 2 in order to provide a stable DC power supply, having a reduced ripple.

At the start up, the first resistor R, the third capacitor C3 and the diac D supply a first current value to the control terminal of the second transistor Q2.

After the start up, the diode D0 inhibits the diac D and the system as a whole is maintained in oscillation by the feedback path to the control terminal of the second transistor Q2 via the transformer T.

In fact, as soon as the second transistor Q2 is on, the current flowing in the primary winding of transformer T (that is a ferrite ring with a saturable core) starts to increase until its core is fully saturated. At this point, the feedback path to the control terminal of the second transistor Q2 is substantially removed and, after its storage time, the second transistor is switched off.

In the mean time, the feedback path realized by the transformer T acts to switch on the first transistor Q1.

It should be emphasized that, once the value of the capacitor C5, and consequently C6, is fixed (according to the power of the fluorescent lamp and the range of frequencies to be utilized), the parameters to be taken into consideration in order to correctly fix the operating frequency of the system 1 are:

The maximum flux density in the core of the transformer T.

The storage time of the transistors Q1 and Q2.

The value of the resistors R5 and R6 connected to the transistors Q1 and Q2 (in correspondence of the emitter terminals in the shown case of bipolar transistors).

It should be also noted that practical considerations impose that the spread of storage time of the used transistors Q1 and Q2 must be tight and known. Also the variability of the magnetic flux in the core of the transformer T must be taken into consideration to correctly dimension the system 1 for the worst case conditions.

FIG. 5 shows, as an example, the steady state waveforms related to a 25 W, 50 Hz–220V mains compact fluorescent lamp driven with a system 1 according to FIG. 4.

Moreover, FIG. 6 illustrates waveforms related to a switch-off condition of the same example lamp discussed in conjunction with FIG. 5.

So, even if effective to drive a compact fluorescent lamp, the known described system 1 shows a main drawback due to the fact that the design of the circuit topology, particularly in connection with the ballast L, depends on the variability of the core saturation in the transformer T as well as on the spread of storage time of the transistors Q1 and Q2.

Also known is a system to supply a fluorescent lamp with a current-resonant-base driving circuit as schematically shown in FIG. 7.

In particular, the resonant driving system 10 is connected to a fluorescent lamp, here represented by its tube 11. A first capacitor C10 is connected in parallel to the tube 11.

The tube 11 of the fluorescent lamp has a first end connected to a first internal node X1 between a second C11 and a third capacitor C12 a well as a second end connected to a primary winding of a transformer TR.

The resonant driving system 10 has a first 11 and a second input terminal 12 connected to a filter 12, in turn connected to a diode bridge circuit 13. The diode bridge circuit 13 is connected to a first inductor L10, which is the ballast of the fluorescent lamp.

The resonant driving system 10 also comprises a DC-to-AC converter 14 inserted between a second internal node X2 (between the first inductor L10 and the second capacitor C11) and a voltage reference, for instance a ground GND.

Finally, the resonant driving system 10 comprises a fourth electrolithic capacitor C14 inserted in parallel to the diode bridge circuit 13 and connected to the first inductor L10 and to the ground GND.

The filter 12, the diode bridge circuit 13 and the fourth capacitor C14 can be seen as an input section of the resonant driving system 10.

The converter 14 comprises a first or high side transistor QH and a second or low side transistor QL of the complementary type, inserted, in series to each other, between the second internal node X2 and ground GND.

In particular, the high side transistor QH is a bipolar transistor of the NPN type, while the low side transistor QL is a bipolar transistor of the PNP type.

The transistors QH and QL have their control or base terminals connected to each other in a third internal node X3. Moreover, the high side transistor QH has its control terminal connected to the second internal node X2 by means of a first resistor RH, while the low side transistor QL has its control terminal connected to the ground GND by means of a second resistor RL.

A fourth internal node X4, defined as the interconnection node between the transistors QH and QL, is connected to one end of the tube 11 of the fluorescent lamp through the primary winding of the transformer TR.

Also shown in FIG. 7 are respective diodes DH and DL connected between the emitter and collector terminals of the bipolar transistors QH and QL.

The current resonant driving system 10 is based on the control circuit 15 inserted between a secondary winding of the transformer TR and the control terminals of the transistors QH and QL. The secondary winding of the transformer TR is also connected to the fourth internal node X4 of the converter 14.

In particular, the control circuit 15 comprises a series of an inductor L15 and a first capacitor CA as well as a second capacitor CB inserted between the third X3 and the fourth internal node X4, also indicated as nodes A and B in FIG. 7. It should be noted that the series of L15 and CA can be seen as a current generator of a driving current I(t) between the nodes A and B. More particularly, the current flowing in the control terminals of the transistors QH and QL plus the currents flowing through the second capacitor CB is equal to such a driving current l(t).

Moreover, as is the common practice in real applications, a snubber circuit 16 is inserted at the output of the DC-AC converter 14 in order to minimize the switching losses of the resonant driving system 10. The snubber circuit 16 comprises a parallel configuration of a capacitor C16 and a resistor R16 and is inserted between the fourth internal node X4 and the ground GND.

It should be noted that the capacitor CB provides a delay time needed for the insertion of the snubber capacitor C16. In fact, the capacitor CB is charged to a voltage equal that of the base-emitter junction of each transistors QH and QL, typically of 1V.

The above-described known system substantially shows a common emitter half bridge topology, thanks to the adoption of the complementary pair of bipolar transistors QH and QL. In fact, the resonant driving system 10 has only one common driving source, in particular the control circuit 15.

It should be noted that the feedback to the transistors has been ensured through a modification of the first inductor L10 or ballast by using just one secondary winding of the transformer TR that accomplishes the task of supplying the voltages needed for the base terminals of the transistors QH and QL with respect to the third internal node X3.

So, the transformer TR need not to saturate at a current level required by the lamp itself. The working frequency is in particular achieved by the LC circuit that results in series with the base terminals of each transistor with a resonant effect.

The current resonant driving system 10 for fluorescent lamps overcomes the problem concerned with the variability of the saturation in the transformer. However, this known solution shows a main drawback due to the fact that the transistors QH and QL have their bases connected together and thus the reverse bias during the off-state is not high enough just 0.8V), especially for the PNP bipolar transistor. Moreover, the transistors QH and QL are driven by a common current resonant circuit that cannot be fine tuned for the specifications of each transistor. The delay time between turn-off of QH and turn-on of QL (and vice versa) is very short and it decreases when the temperature increases (due to the lower Vbe).

SUMMARY OF THE INVENTION

An embodiment of this invention provides for a system for driving a fluorescent lamp having at least one end connected to a primary winding of a transformer, the system comprising a pair of transistors of the complementary type and a pair of capacitors connected in series with the control terminals of the transistors in order to allow different driving for the transistors themselves as well as for a control circuit of the voltage resonant type. Such a system overcomes the problems besetting the systems of FIGS. 3, 4, and 7, namely the variability of the saturation in the transformer, the spread of storage time of the transistors, and the driving and sizing of the transistors.

BRIEF DESCRIPTION OF THE DRAWINGS

The features and advantages of the invention will be apparent from the following description of an embodiment thereof, given by way of non-limitative example with reference to the accompanying drawings.

DETAILED DESCRIPTION OF THE INVENTION

Figure 8:
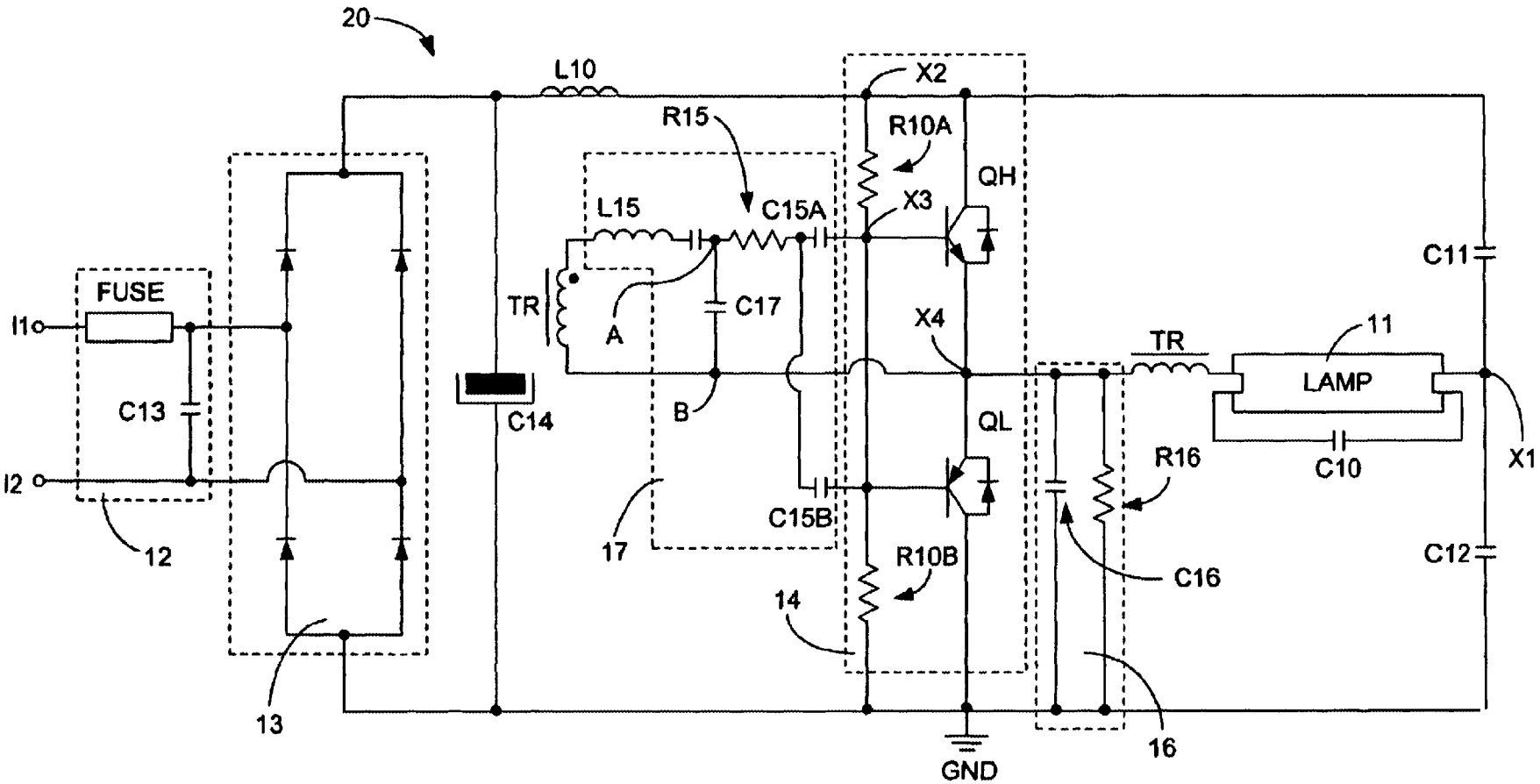
FIG. 8 is a schematic diagram of a voltage-resonant-driving system for a fluorescent lamp according to an embodiment of the invention.

Shown in FIG. 8 is a simplified schematic diagram of a voltage-resonant driving system 20 for a fluorescent lamp according to an embodiment of the invention.

In particular, similar as the current-resonant driving system 10 previously described in connection with FIG. 7, the resonant driving system 20 is connected to a fluorescent lamp, here represented by its tube 11. A first capacitor C10 is connected in parallel to the tube 11.

The tube 11 of the fluorescent lamp has a first end connected to a first internal node X1 between a second C11 and a third capacitor C12 a well as a second end connected to a primary winding of a transformer TR.

The voltage-resonant driving system 20 has a first 11 and a second input terminal 12 connected to a filter 12, in turn connected to a diode bridge circuit 13. The diode bridge circuit 13 is connected to a first inductor L10, which is the ballast of the fluorescent lamp.

The voltage-resonant driving system 20 also comprises a DC-to-AC converter 14 inserted between a second internal node X2 (intermediate to the first inductor L10 and the second capacitor C11) and a voltage reference, for instance a ground GND.

Finally, the voltage-resonant driving system 20 comprises a fourth electrolithic capacitor C14 inserted in parallel to the diode bridge circuit 13 and connected to the first inductor L10 and to the ground GND in order to guarantee a stable DC power supply, having a reduced ripple.

The filter 12, the diode bridge circuit 13 and the fourth capacitor C14 can be seen as an input section of the resonant driving system 20.

The converter 14 comprises a first or high side transistor QH and a second or low side transistor QL of the complementary type, inserted, in series to each other, between the second internal node X2 and ground GND.

In particular, the high side transistor QH is a bipolar transistor of the NPN type, while the low side transistor QL is a bipolar transistor of the PNP type.

A fourth internal node X4, defined as the interconnection node between the transistors QH and QL, is connected to one end of the tube 11 of the fluorescent lamp through the primary winding of the transformer TR.

The voltage-resonant driving system 20 in particular comprises a control circuit 17 inserted between a secondary winding of the transformer TR and the third internal node X3 of the converter 14, such a secondary winding of the transformer TR being also connected to the fourth internal node X4 of the converter 14.

Advantageously according to an embodiment of the invention, the control circuit 17 comprises an inductor L15 in series with a resistor R15. Advantageously according to an embodiment of the invention, the control circuit 17 further comprises as first capacitor C15A inserted between the resistor R15 and the base terminal of the high side transistor QH as well as a second capacitor C15B inserted between the resistor R15 and the base terminal of the low side transistor QL.

Finally, the control circuit 17 also comprises a further capacitor C17 inserted between a first A and a second node B, the first node A being the intermediate node between the inductor L15 and the resistor R15 and the second node B being connected to the fourth internal node X4.

It should be noted that, thanks to the further capacitor C17, the resonant driving system 20 according to an embodiment of the invention turns out to be a voltage resonant circuit. The resistor Rl5 provides for supplying the driving current into the control terminals of the high side QH and low side QL transistors.

Advantageously according to an embodiment of the invention, the converter 14 also comprises a first resistor R10A inserted between the second internal node X2 and the base terminal of the high side transistor QH as well as a second resistor R10B inserted between the base terminals of the transistors QH and QL to ensure the oscillations start-up for the converter in every condition.

Moreover, as is the common practice in real applications, a snubber circuit 16 is inserted at the output of the DC-AC converter 14 in order to minimize the switching losses of the resonant driving system 20. In fact, a particular care is used to reduce all losses that could bring the junction temperature of the transistors QL and QH higher than its maximum rating (generally 150° C.). In this regards, it should be taken into account that the resonant driving system 20 is encapsulated in a lamp and that the ambient temperature can easily exceeds 100° C.

The snubber circuit 16 substantially comprises a parallel configuration of a capacitor C16 and a resistor R16 and is inserted between the fourth internal node X4 and the ground GND.

Figure 7:
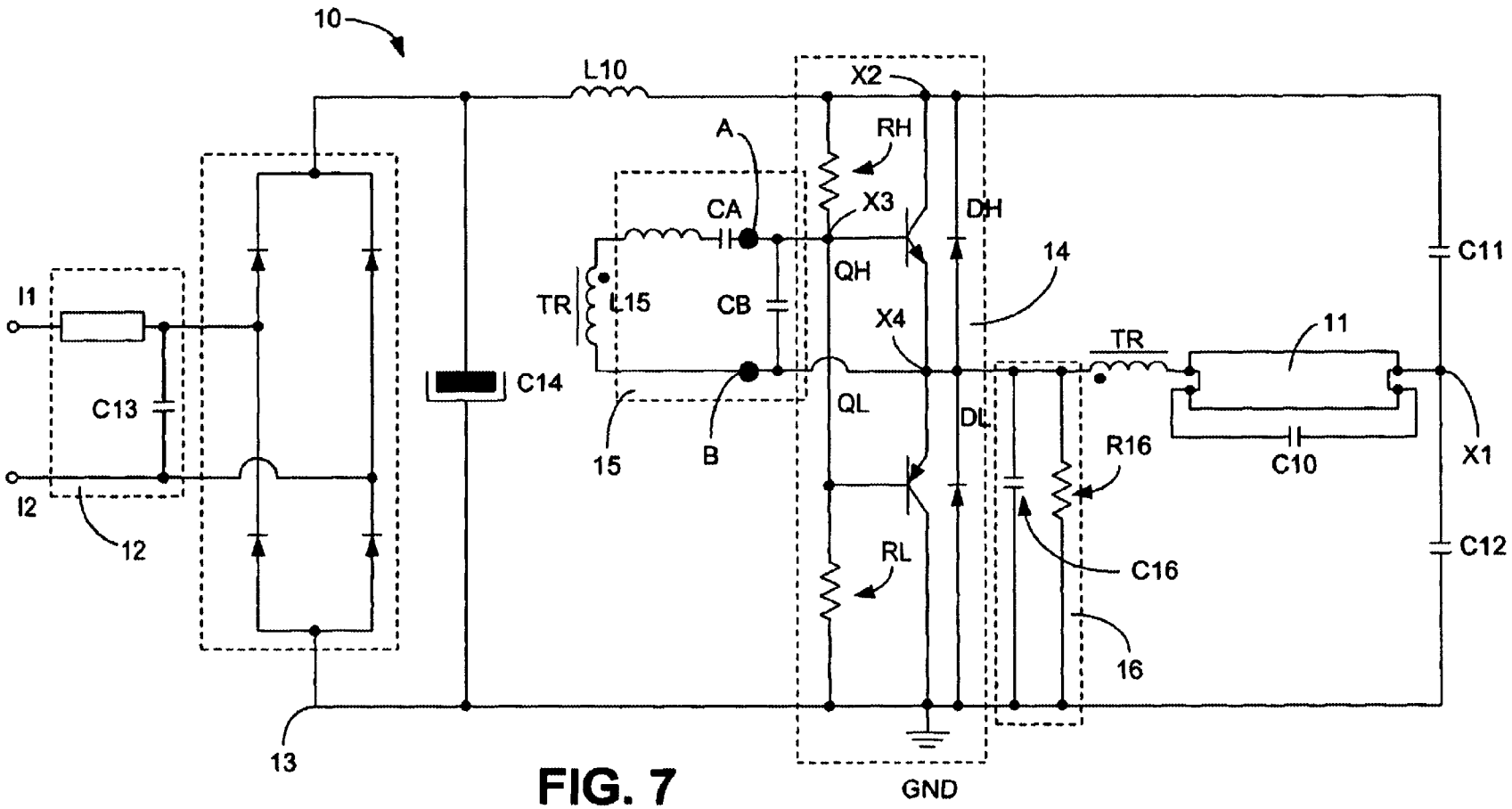
FIG. 7 (PRIOR ART)
FIG. 7 is a schematic diagram of a current-resonant-driving system for a fluorescent lamp according to the prior art.

According to the prior art solution shown in FIG. 7, the current-resonant control circuit 15 comprising a pair of capacitors (CA, CB) connected to the control terminals of the transistors of the converter 14 provides for a correct operation of the resonant driving system 10 comprising the snubber circuit 16.

In fact, during the turning off of the high side transistor QH (FIG. 7), its base-emitter voltage Vbe is positive until all the charges in its base terminal have been eliminated (the so-called storage time effect). Only after the storage time the voltage Vbe becomes negative and the output current starts to fall. Only at this point, the low side transistor QL starts to conduct.

The presence of the capacitor C16 of the snubber circuit 16 would require a delay time equal to the constant time imposed by the value of the capacitor chosen for the snubber function.

However, the base terminals of the transistors QH and QL are directly linked and, a single capacitor CA in the control circuit 15 cannot assure the necessary delay time to allow the charge and discharge of C16 without high turn-on losses on the transistors and the advantage of the turn-off zero crossing due to the snubber circuit 16 would be eliminated. Only the effect of a big capacitor CB can assure a delay time.

According to the embodiment of the invention (FIG. 8), the doubled capacitors C15A and C15B, allow a correct operation of the snubber circuit 16.

To better understand the conceptual function of the resonant driving system 20, reference is made in the following lines to the schematization shown in FIG. 9.

In particular, the circuit part comprising the inductor L15 and the capacitor C17 inserted in the secondary winding of the transformer TR is represented in a functional manner as a sinusoidal voltage generator V(t) acting between the points A and B. It should be noted that, due to the resonant effect of the inductor L15-capacitor C17, the voltage value V(t) between the points A and B is higher than the voltage value imposed by the secondary winding of the transformer TR, so that very few additional winds on the ballast inductor L10 are needed to obtain the secondary winding.

Figure 9:
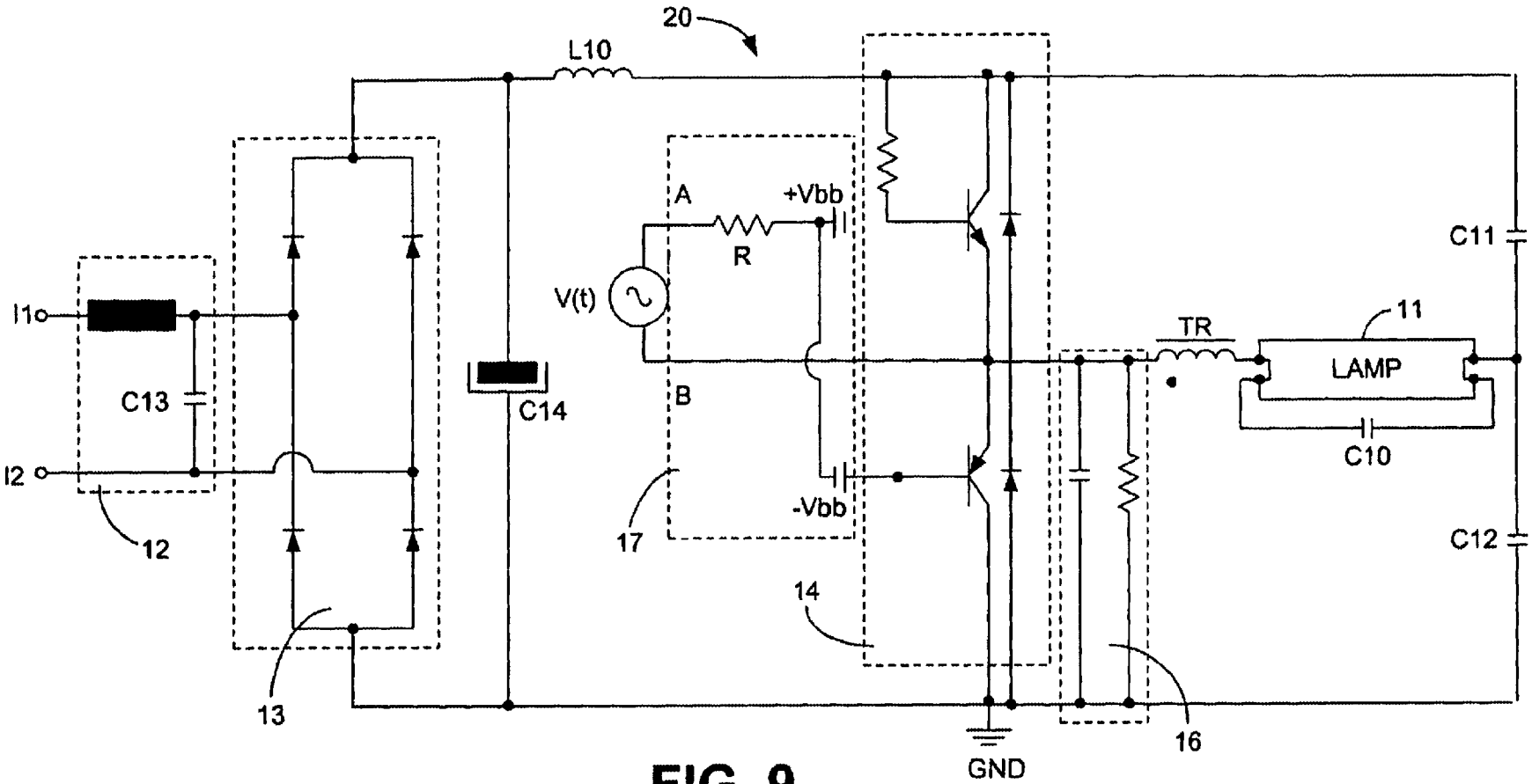
FIG. 9 is schematization showing the conceptual function of the resonant driving system of FIG. 8.

Moreover, in FIG. 9 the capacitors C15A and C15B are represented in a functional manner by two DC voltage generators +Vbb and −Vbb in series with the base terminal of the transistors QH and QL respectively. The capacitors C15A and C15B provides for voltage values that are regulated by the resistor R10B.

Figure 10:
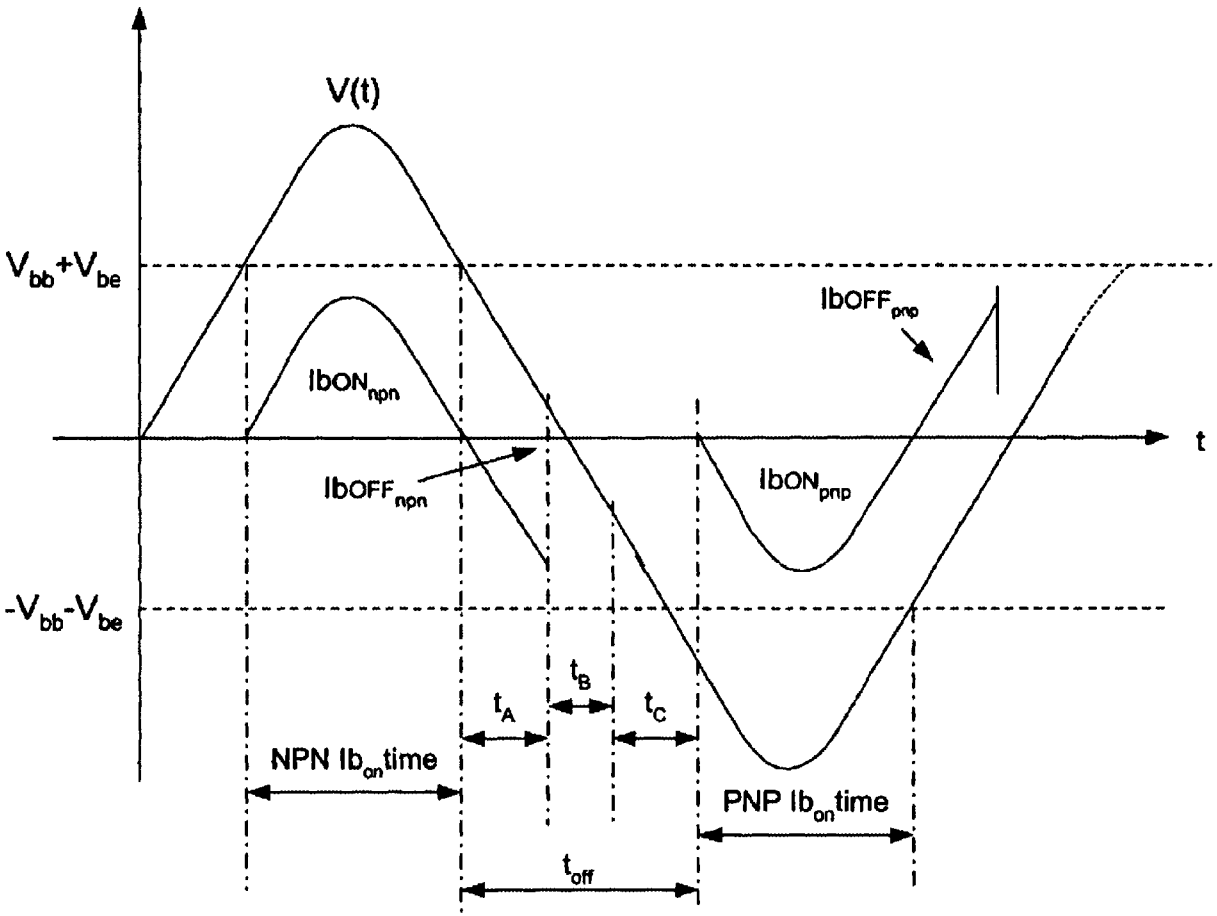
FIGS. 10 to 13 show waveforms related to a fluorescent lamp driven by a resonant driving system according to FIG. 8.

According to the schematization of FIG. 9, one can derive the conceptual driving waveforms, as shown in FIG. 10. So, it is evident that, starting from a driving voltage V(t), the turn-on of the NPN transistor QH is possible only when the voltage V(t) is higher than the voltage Vbb and the base-emitter voltage Vbe: Vbb+Vbe.

In a similar way, it can be derived that the turn-on of the PNP transistor QL is only possible when the voltage V(t) is lower than −Vbb−Vbe.

In this way, a sufficient delay time has been ensured between the turn-off of a transistor with respect to the turn-on of its complementary one. More effectively, a reverse VBEoff (typically ranging from−4V to −7V in the NPN and from 4V to 7V in the PNP) has been ensured, thus avoiding spurious re-conduction due to unforeseeable noises and ensuring a ruggedness in VCEV breakdown for the PNP device.

In particular, the capacitors C15A and C15B are charged with opposite polarity and they assume the same polarity of the relevant value of Vbeon. The resistor R10B inserted between the base terminals of the transistors QH and QL, by creating an alternative path for the charge and discharge of the two capacitors, prevents blocking of the start-up oscillator when one of the two capacitors is fully charged. Moreover, the additional resistor R10B also allows a regulation of the DC voltage source value supplied by the capacitors C15A and C15B.

Finally, the additional resistor R10B also allows the ballast designer to fine tune the working frequency and consequently the power supplied to the lamp 11.

Moreover, the additional capacitor C17 provides for a fine tune of the phase imposed through the inductance L15, thus overcoming the difficulty of perfectly matching the phase imposed through the inductance L15 and thus ensuring that the base current is in phase with the collector current in the transistors QH and QL.

The applicant has used the resonant driving system 20 in order to drive a 20 W, 220V compact fluorescent lamp.

Figure 11:
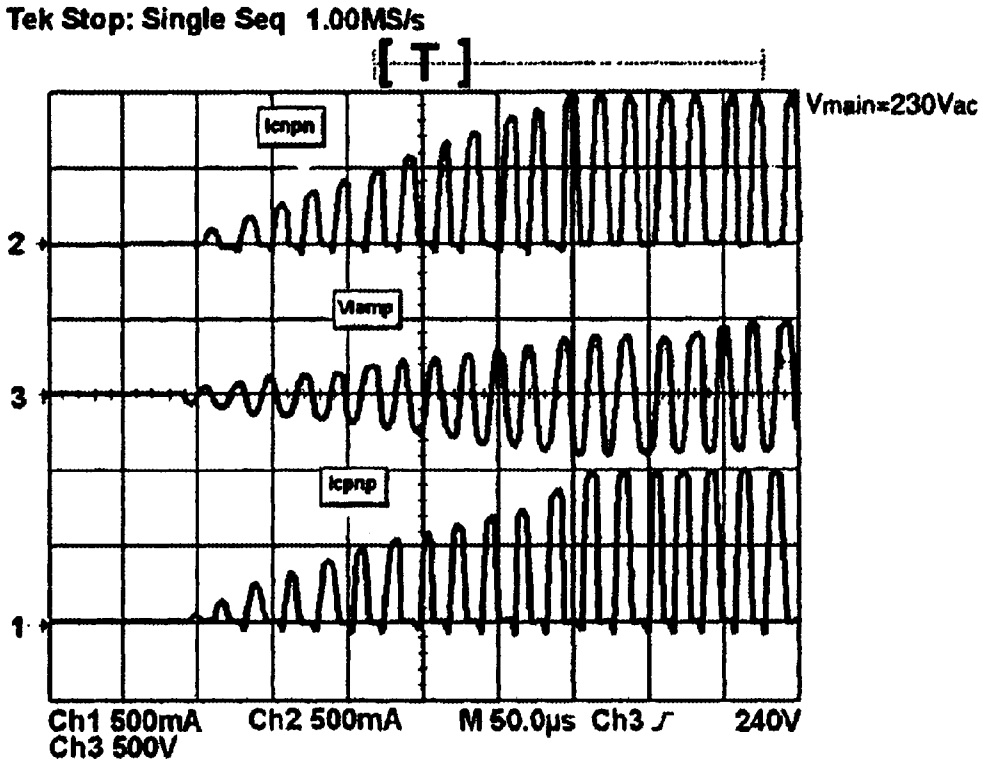

In particular, a high-gain complementary pair of bipolar transistors have been used. In particular, the PNP used transistor exhibits the following features:

$V_{CES}$>500 V $V_{CEO}$>400 V $V_{CE(sat)}$=200 mV typ.@$I_c$=350 mA, $I_8$=50 mA $h_{FE}$ =30 typ.@$I_c$=350 mA It has been verified that the PNP transistor shows an excellent gain at high current level, in particular its $h_{FE}$ higher than 5 at $I_c$=1A ensures the ignition of the lamp 11 during the start-up phase (as shown in FIG. 11).

Figure 2:
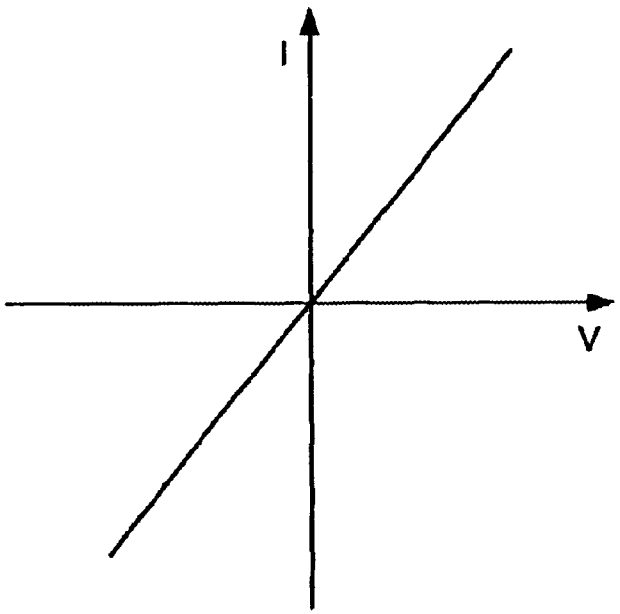
FIG. 2 (PRIOR ART)
FIG. 2 is a steady-state I–V characteristic of a fluorescent lamp according to the prior art
Figure 1:
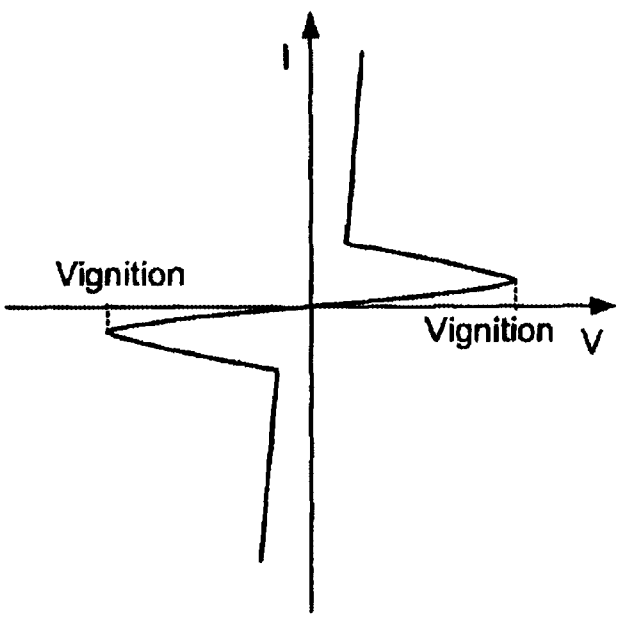
FIG. 1 (PRIOR ART)
FIG. 1 is a start-up I–V characteristic of a fluorescent lamp according to the prior art.
Figure 3:
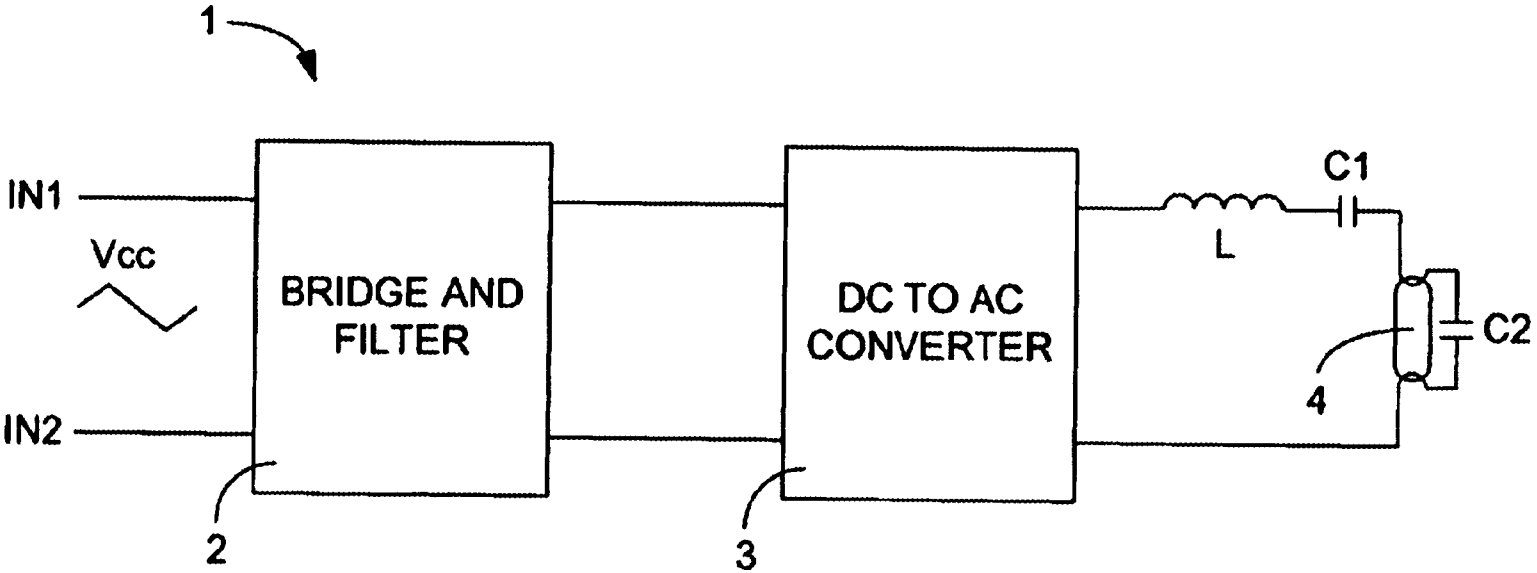
FIG. 3 (PRIOR ART)
FIG. 3 is a schematic diagram of a system for driving a fluorescent lamp connected to a ballast according to a known voltage-fed topology.
Figure 4:
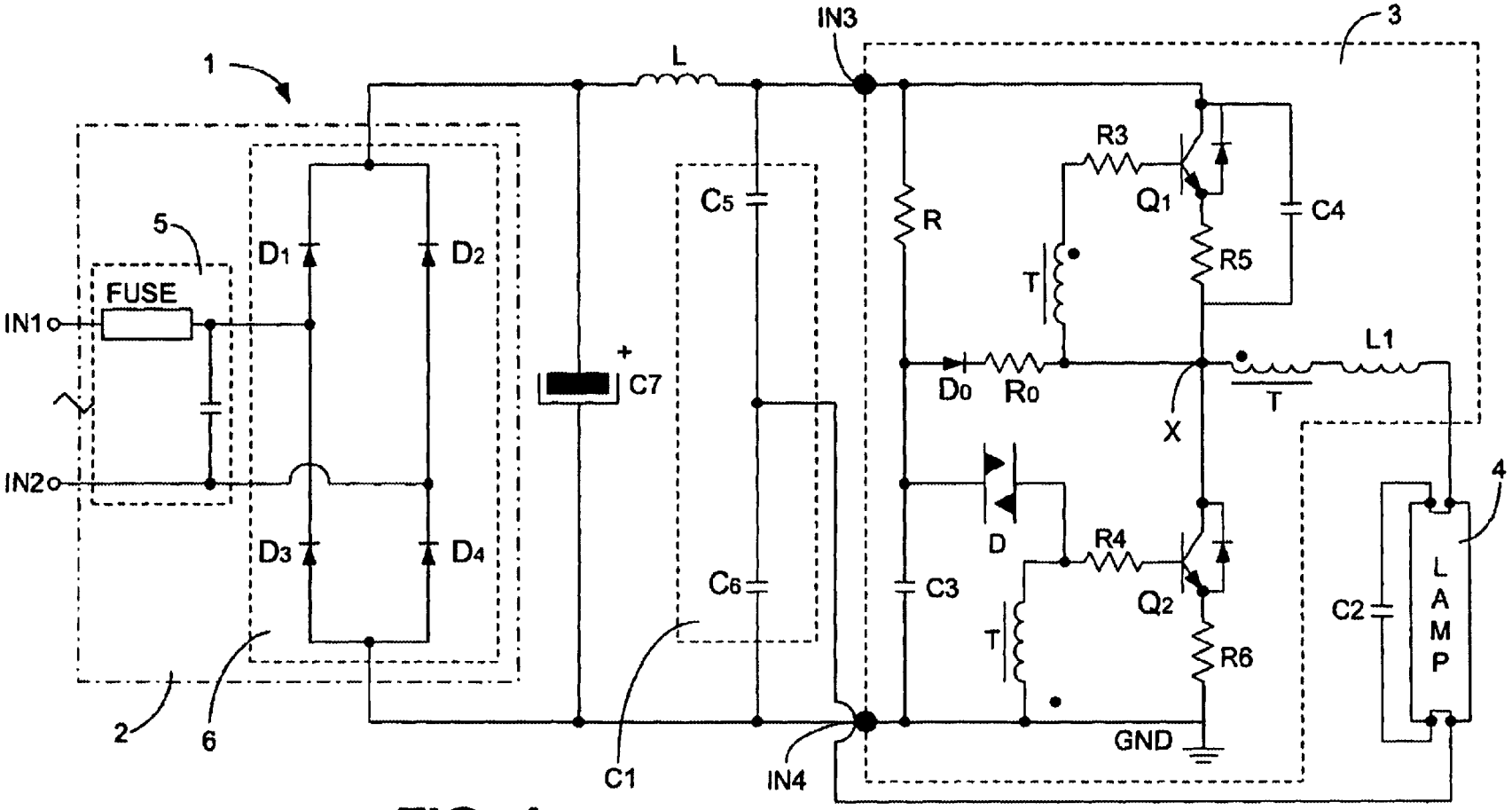
FIG. 4 (PRIOR ART)
FIG. 4 is the system of FIG. 3 in a greater detail.

A comparison has been made between the switching waveforms related to the resonant driving system 20 and the traditional self-oscillating topology shown in FIG. 4.

Figure 5:
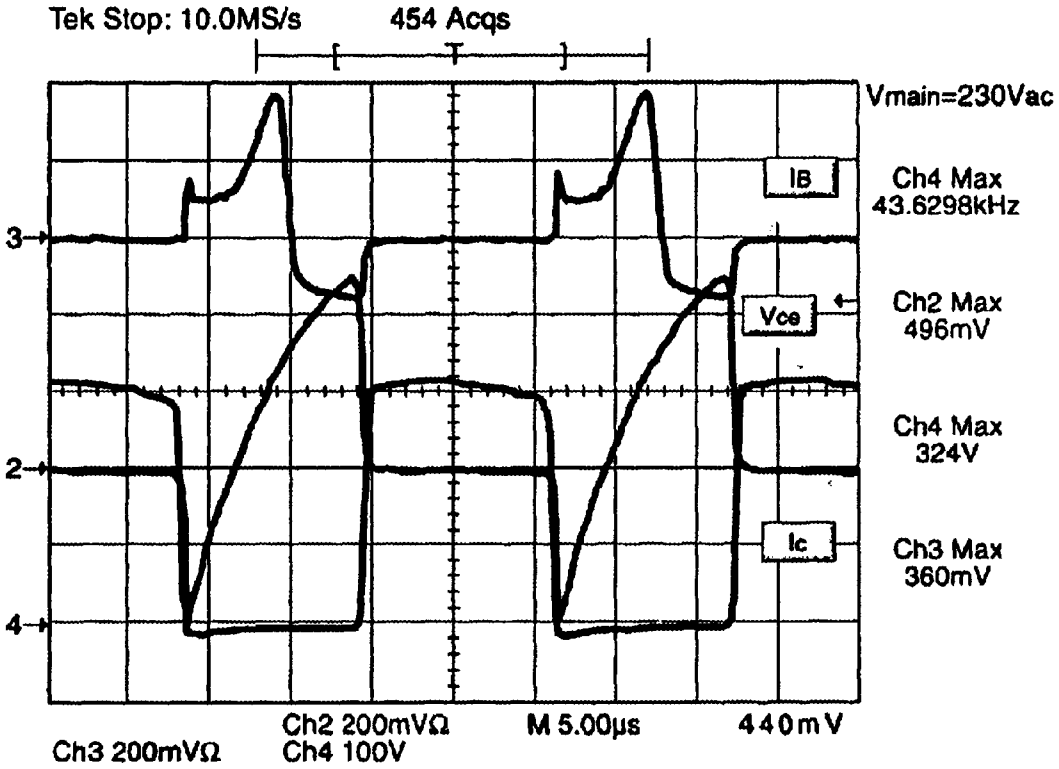
FIG. 5 (PRIOR ART)
FIGS. 5 and 6 show waveforms related to a fluorescent lamp driven by a system according to FIG. 4.
Figure 6:
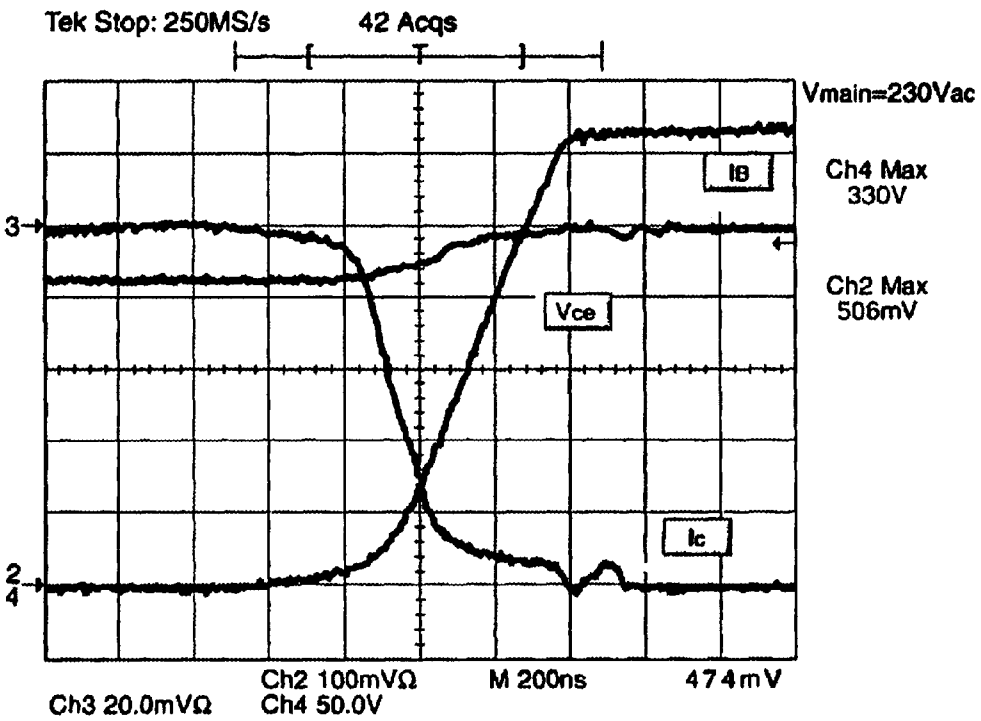
FIG. 6 (PRIOR ART)

It should be noted that the base current exhibits the typical behavior related to the storage time of the bipolar transistors, in particular the IBoff assumes the rectangular shape also shown in FIG. 5.

In the known system 1 of FIG. 4, the bipolar transistors work with a forced gain equal to four, in order to establish a correct storage time and to ensure at the same time that the current on the secondary winding of the transformer is high enough to not saturate quickly, thus achieving the requested working frequency.

Figure 12:
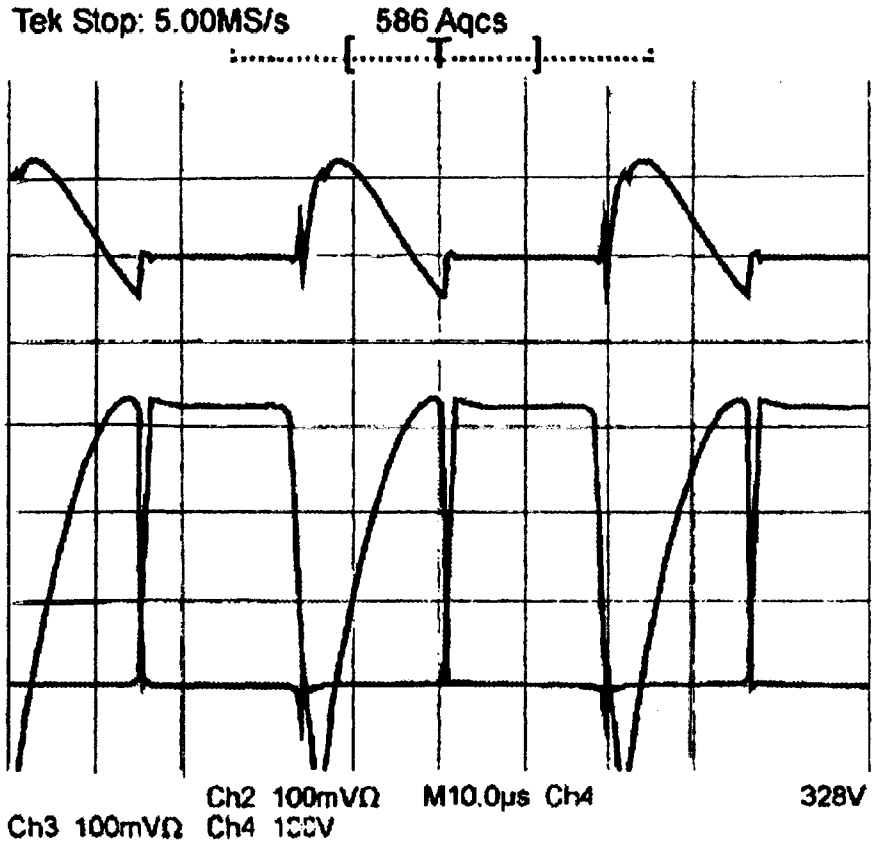

On the contrary, the resonant driving system 20 according to an embodiment of the invention imposes the extraction of the charges from the base, making any consideration about the storage time of the bipolar transistors QH and QL less important. The base current for such resonant driving system 20 assumes the triangular shape illustrated in FIG. 12 where the waveforms related to the PNP transistor have been depicted.

Figure 13:
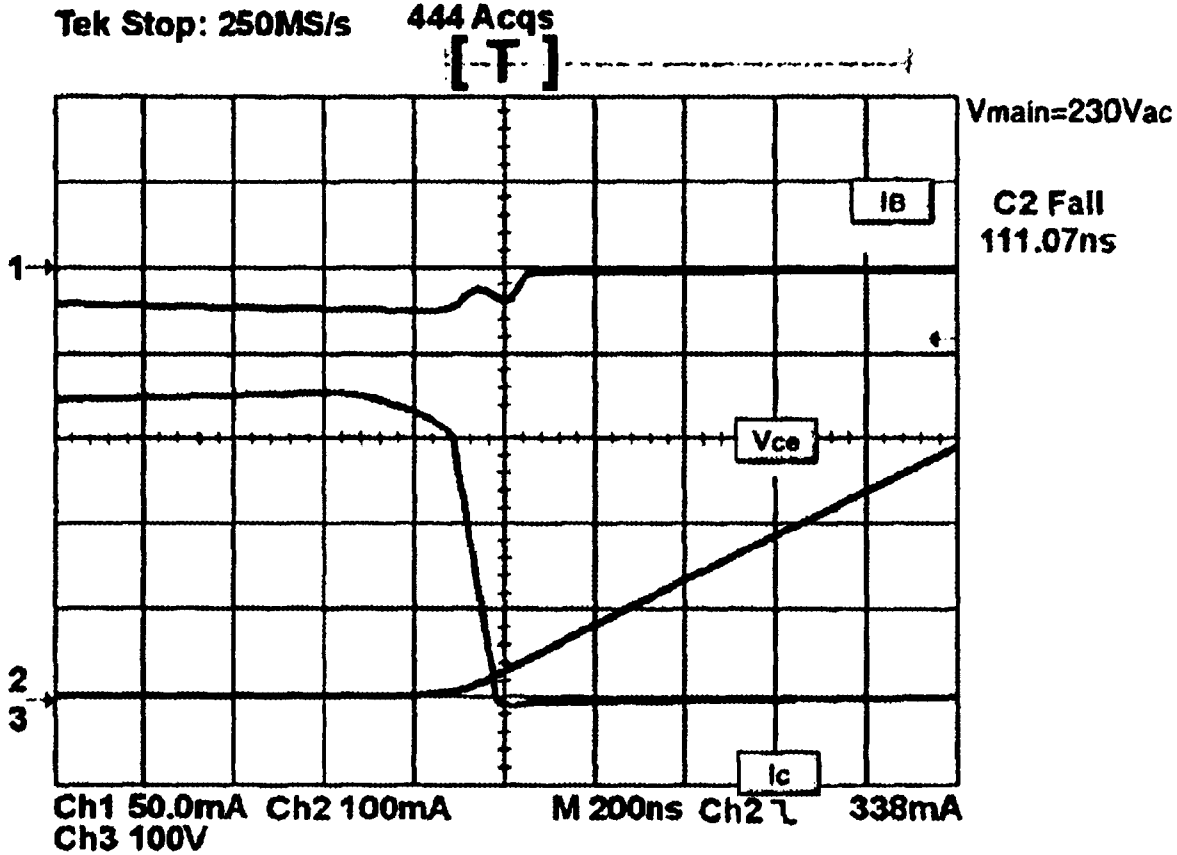
Figure 2:
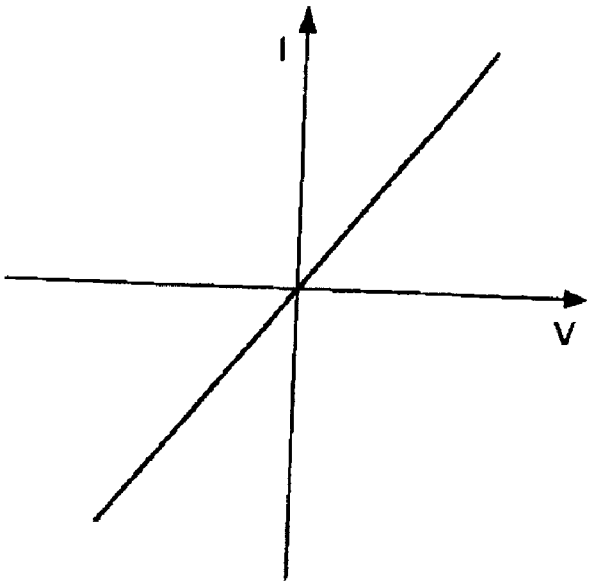
FIG. 2 (PRIOR ART)
Figure 1:
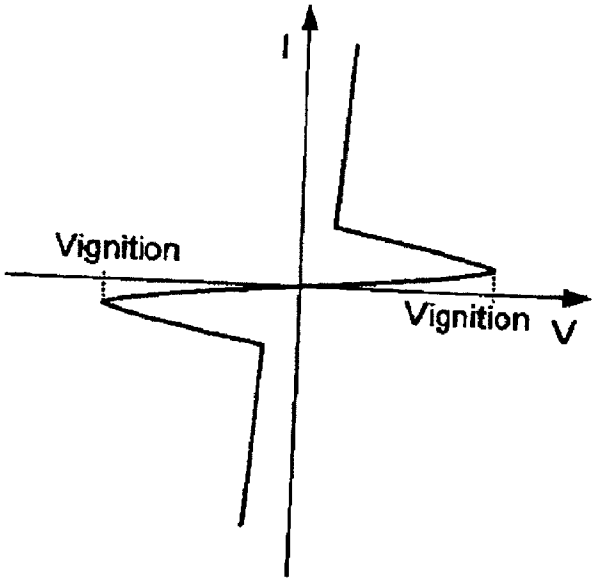
FIG. 1 (PRIOR ART)
Figure 3:
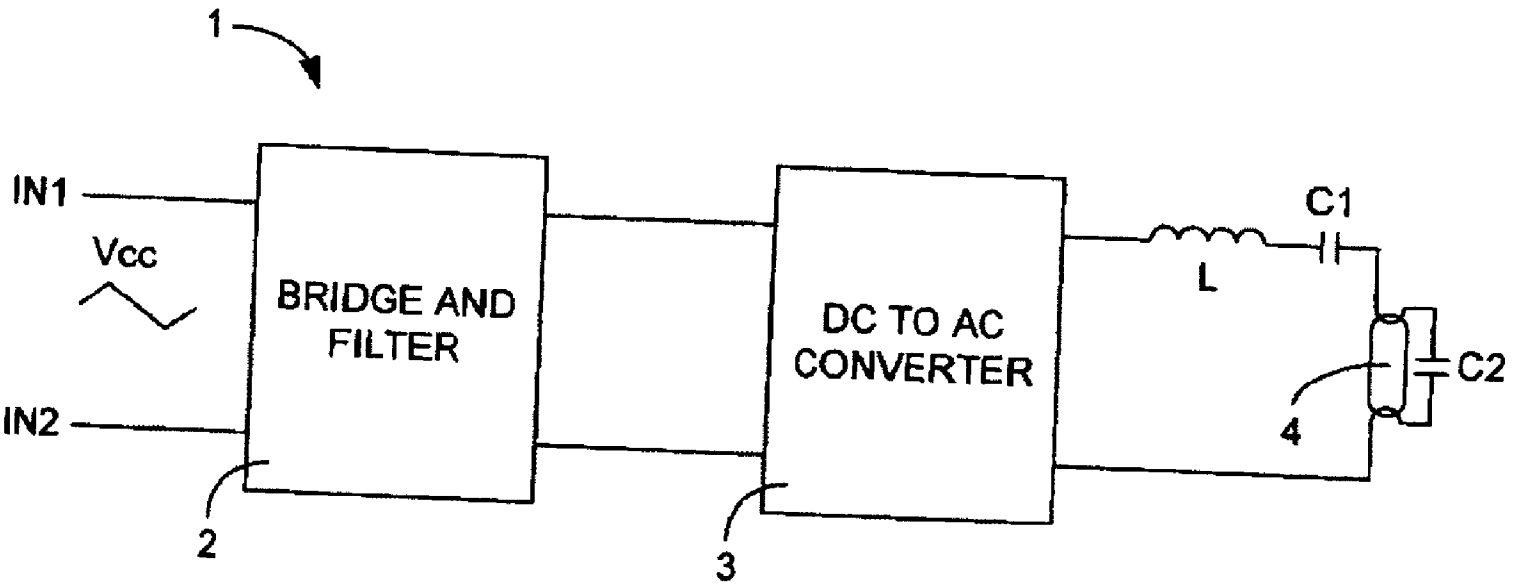
FIG. 3 (PRIOR ART)
Figure 4:
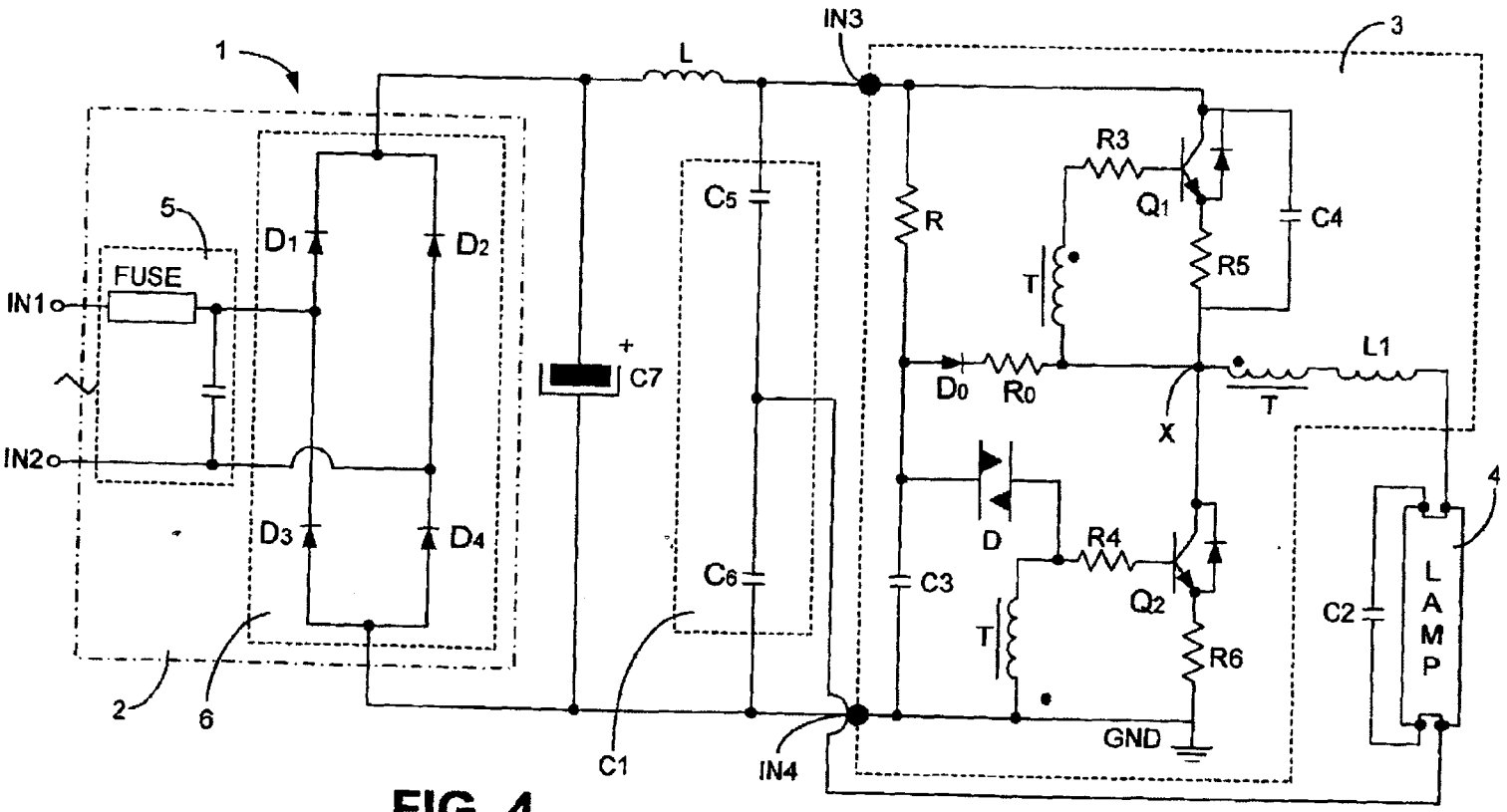
FIG. 4 (PRIOR ART)
Figure 5:
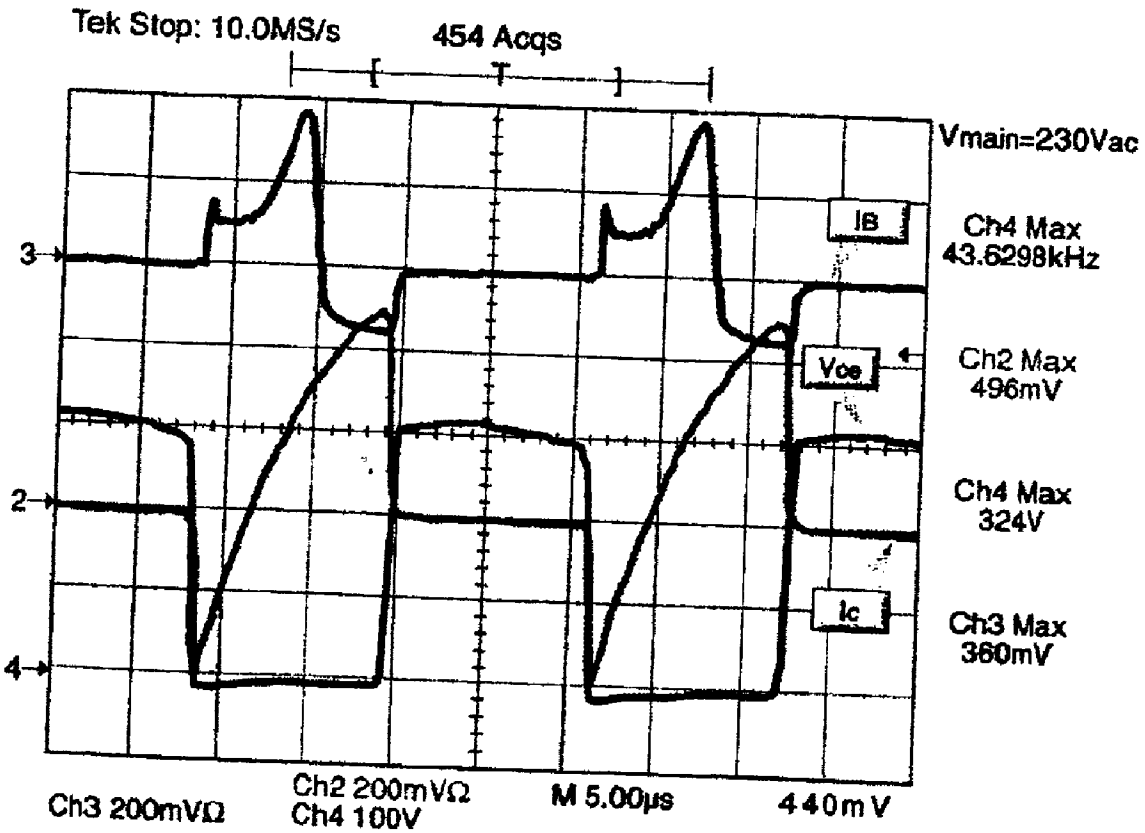
FIG. 5 (PRIOR ART)
Figure 6:
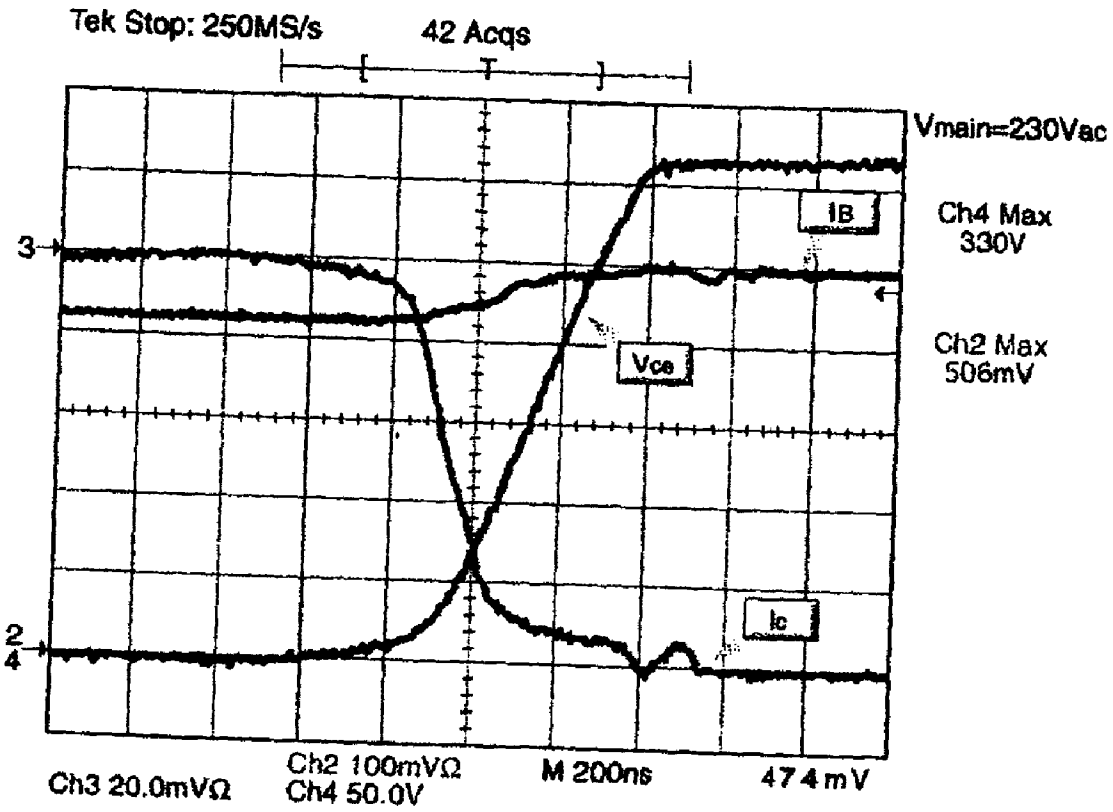
FIG. 6 (PRIOR ART)
Figure 7:
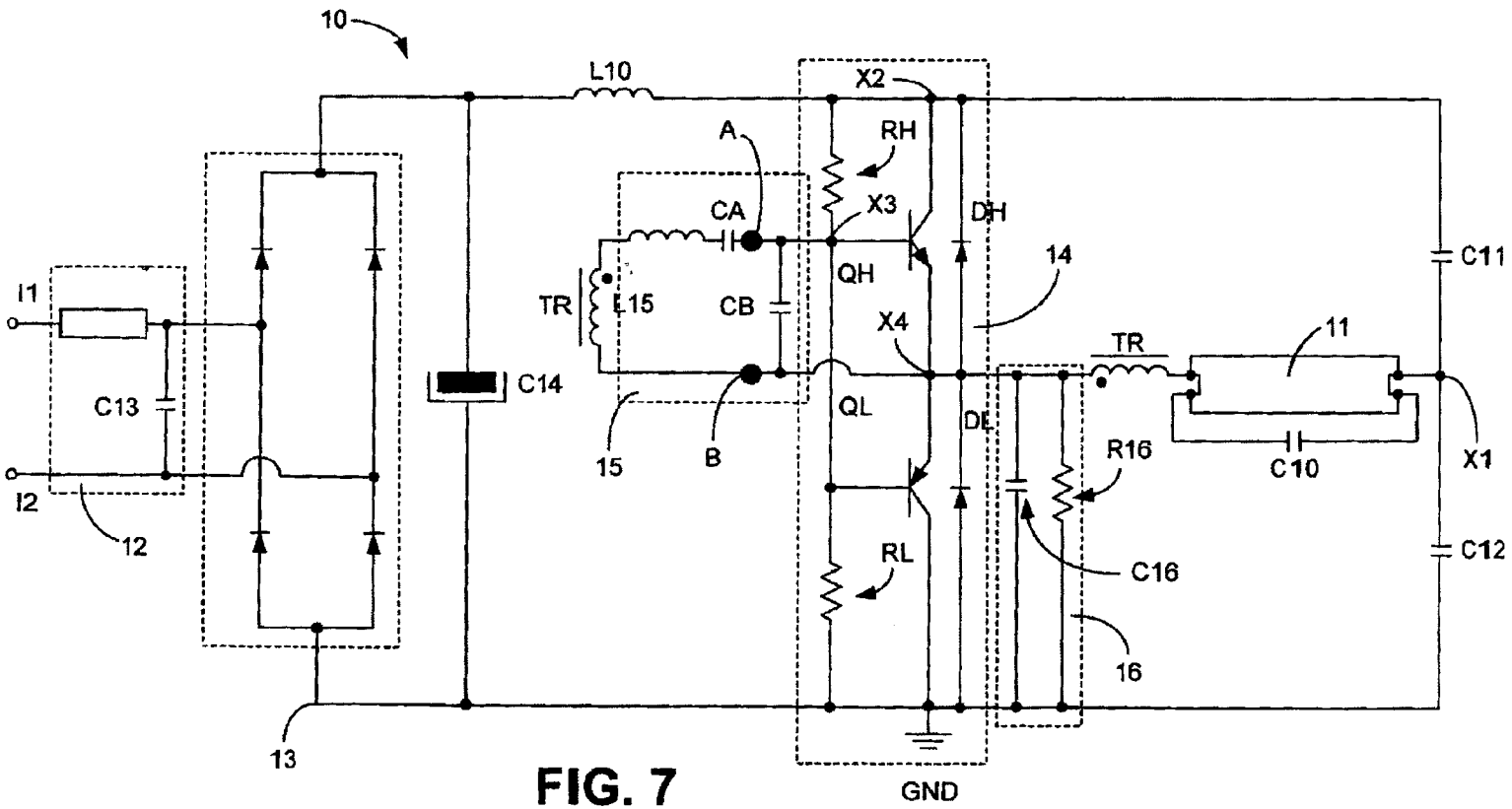
FIG. 7 (PRIOR ART)
Figure 10:
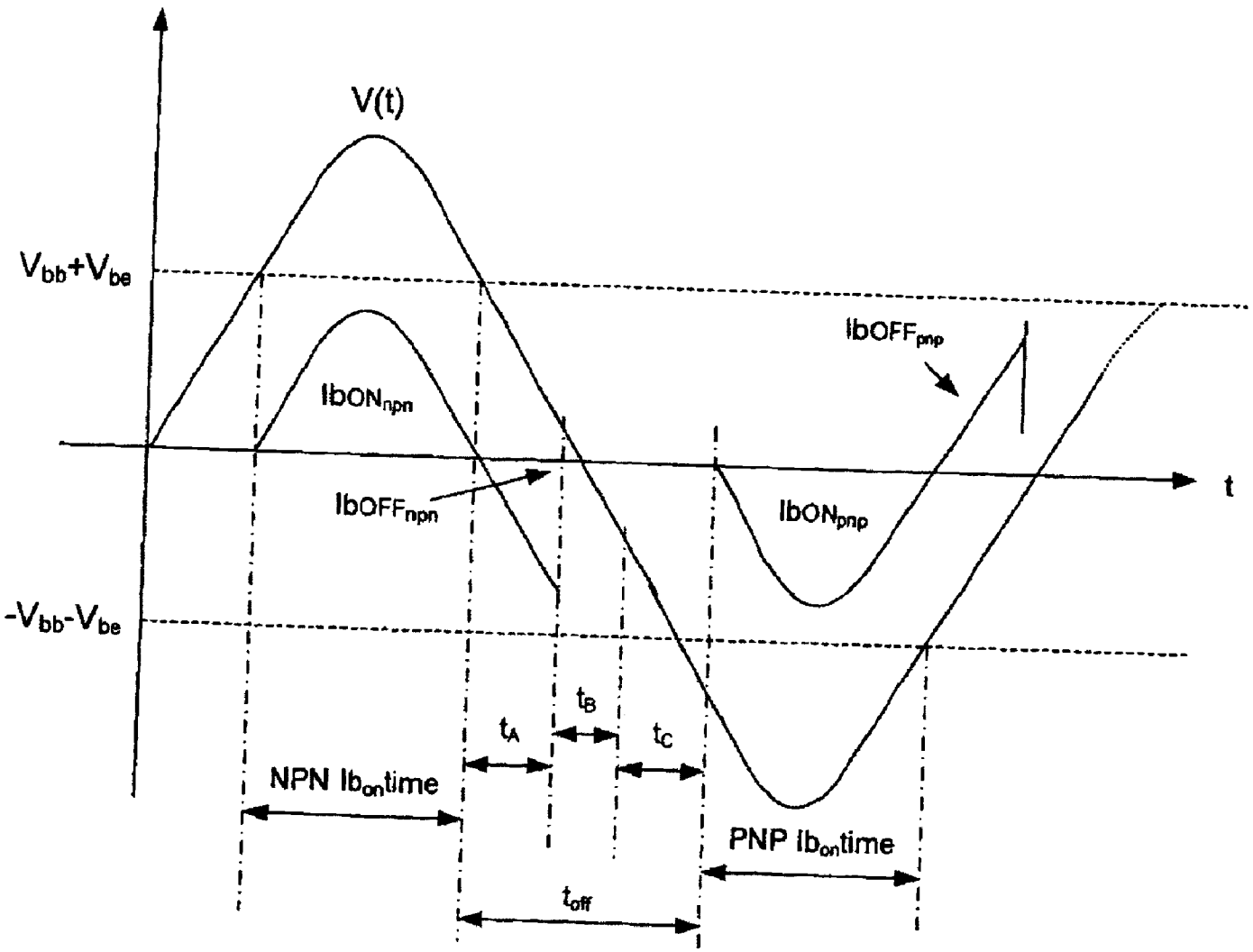
Figure 11:
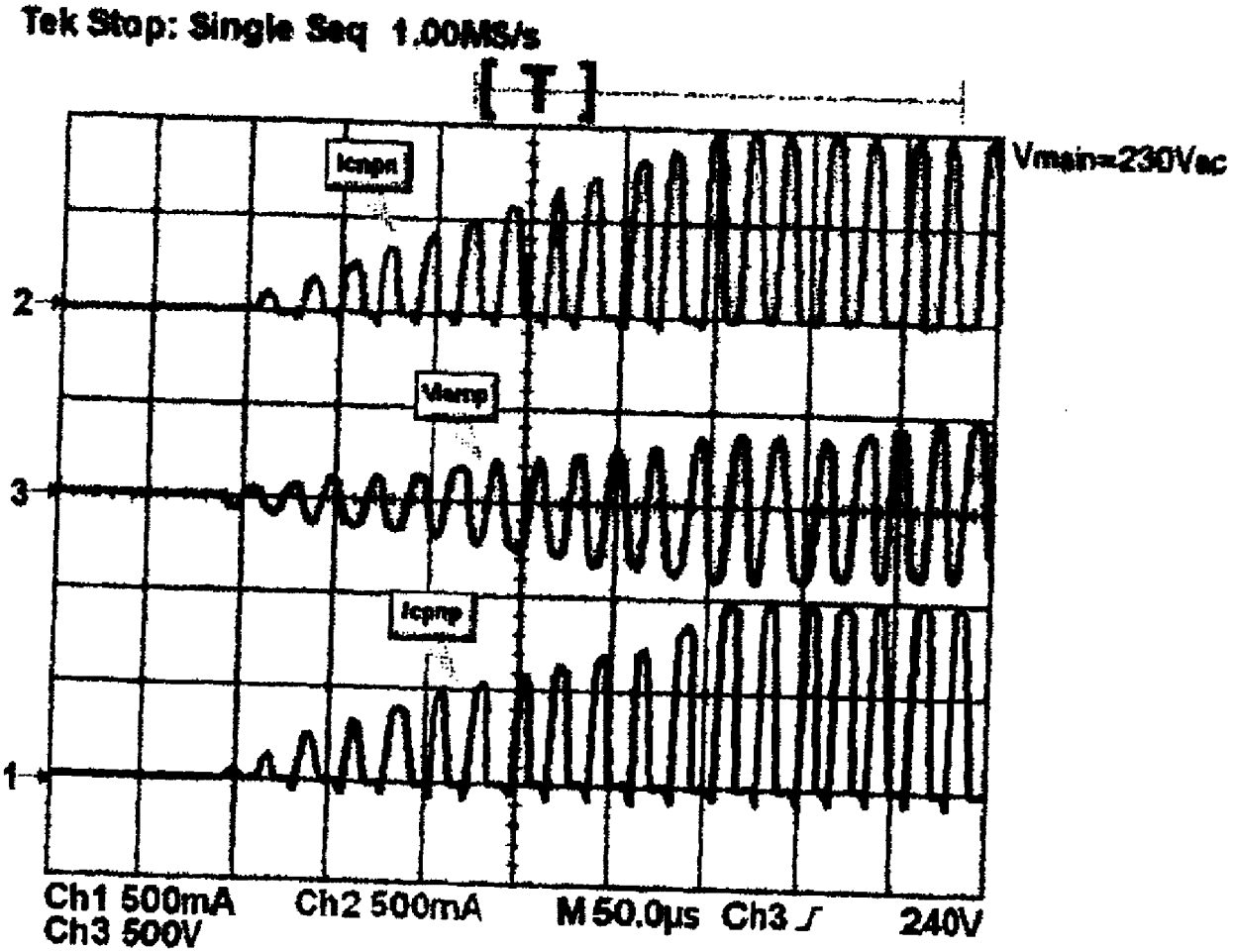
Figure 12:
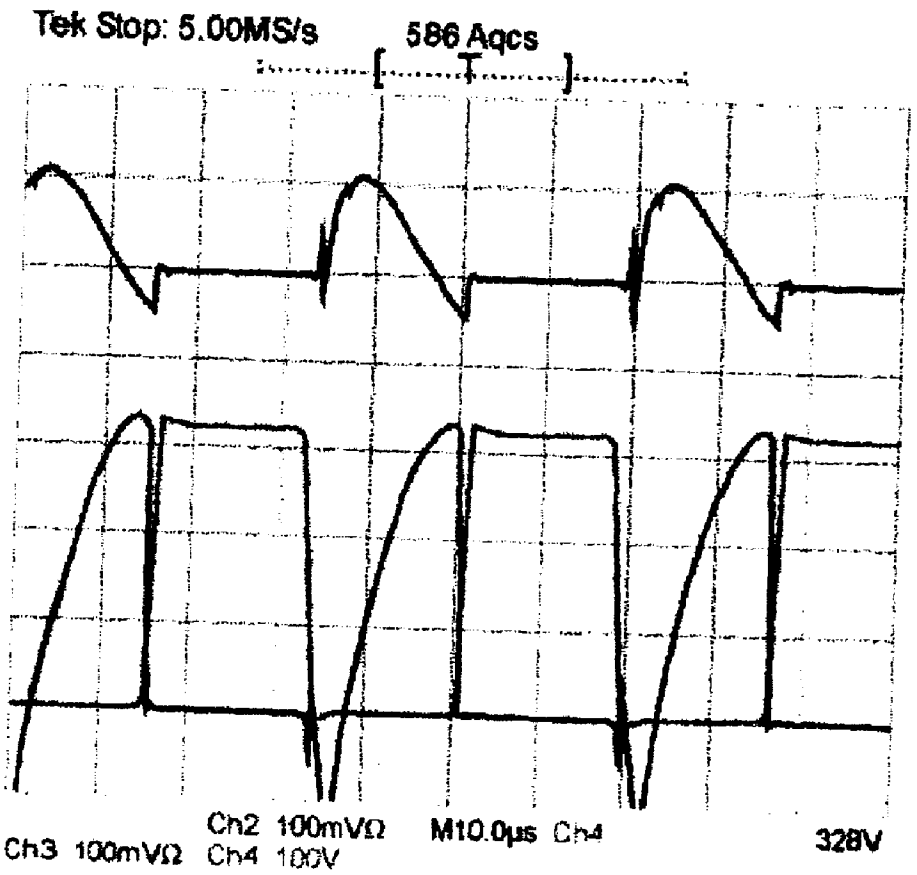
Figure 13:
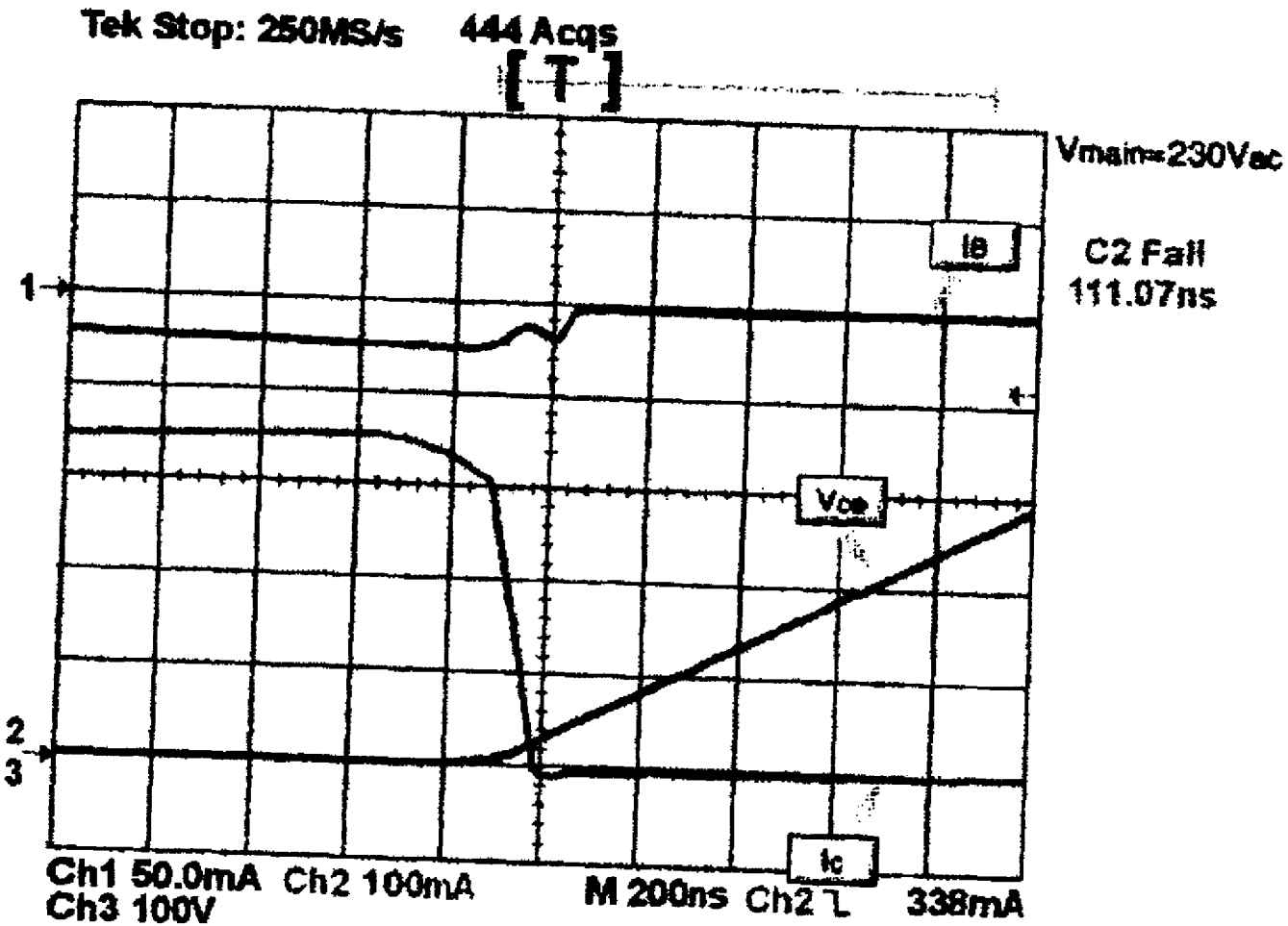

A major advantage of the resonant driving system 20 is also evident when looking at the switch off, as shown in FIG. 13. As a matter of the fact, the commutation results virtually lack the tail effect. Moreover, it should be noted that the PNP transistor exhibits a fall time of about 110ns that is not common for a high voltage PNP transistor.

In other words, the effect of the variation of the storage time in the resonant drive solution according to an embodiment of the invention is drastically reduced leading the bipolar transistors to operate with good switching performances.

Moreover, the waveforms related to both NPN and PNP transistors have been reproduced in FIG. 13. Such waveforms show a more than satisfactory symmetry in normal operative conditions.

Finally, the resonant driving system according to the embodiment of the invention allows designers of compact fluorescent lamps not only to simplify and consequently cut the cost of the application, but to also reduce the design window since one of the most important variables to be taken into consideration, the variability of the storage time of the transistors, can be neglected during the tune up of the project.

It should be emphasized that the use of double capacitors C15A and C15B connected to the base terminals of the transistors QH and QL allows the use of a PNP transistor which exhibits a BVces>500V while the NPN transistor has a BVces>700V. In this way, the PNP transistor has a die-size and a cost which is the half with respect to a PNP transistor exhibiting a BVces>700V.

Moreover, the use of double capacitors C15A and C15B provides for a different driving to the base terminals of the bipolar transistors QH and QL, such different driving being used when the Hfe is not perfectly identical.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. Resonant driving system for a fluorescent lamp having at least one end connected to a primary winding of a transformer, the resonant driving system comprising:

an inductor inserted between an input section of the resonant driving system and an internal circuit node, in turn connected to another end of the fluorescent lamp;

a converter inserted between the internal node and a voltage reference and comprising a first transistor and a second transistor of the complementary type, inserted, in series to each other, between the internal node and the voltage reference; and a control circuit connected to a secondary winding of the transformer and to the converter as well as to the control terminals of the first and second transistors of the converter wherein the control circuit comprises an inductor connected to a resistor, in turn connected to the control terminals of the first and second transistors respectively through a first and a second capacitor.

2. Resonant driving system of claim 1, wherein the control circuit further comprises a capacitor connected between the inductor and a further internal node defined as the interconnection point between the first and second transistors.

3. Resonant driving system of claim 1, wherein the secondary winding of the transformer is connected a further internal node defined as the interconnection point between the first and second transistors.

4. Resonant driving system of claim 1, further comprising a first resistor connected between the control terminal of the first transistor and the internal circuit node and a second resistor connected between the control terminals of the first and second transistors.

5. Resonant driving system of claim 1, further comprising a snubber circuit connected at the output of the converter between the primary winding of the transformer and the voltage reference, the snubber circuit comprising a capacitor and a resistor connected in parallel to each other between the primary winding of the transformer and the voltage reference.

6. Resonant driving system of claim 1, wherein the first and second transistors are bipolar transistors of the NPN and PNP type respectively.

7. Resonant driving system for driving a fluorescent lamp having at least one end connected to a primary winding of a transformer, the resonant driving system comprising:

an inductor inserted between an input section of the resonant driving system and an internal circuit node, in turn connected to another end of the fluorescent lamp;

a converter inserted between the internal node and a voltage reference and comprising a first transistor and a second transistor of the complementary type, inserted, in series to each other, between the internal node and the voltage reference;

a snubber circuit connected at the output of the converter between the primary winding of the transformer and the voltage reference; and a control circuit connected to a secondary winding of the transformer and to the converter as well as to the control terminals of the first and second transistors of the converter wherein the control circuit comprises an inductor connected to a resistor, in turn connected to the control terminals of the first and second transistors respectively through a first and a second capacitor as well as a capacitor connected between the inductor and a further internal node defined as the interconnection point between the first and second transistors.

8. Resonant driving system of claim 7, wherein the snubber circuit comprises a capacitor and a resistor connected in parallel to each other between the primary winding of the transformer and the voltage reference.

9. Resonant driving system of claim 7, wherein the secondary winding of the transformer is connected a further internal node defined as the interconnection point between the first and second transistors.

10. Resonant driving system of claim 7, further comprising a first resistor connected between the control terminal of the first transistor and the internal circuit node and a second resistor connected between the control terminals of the first and second transistors.

11. Resonant driving system of claim 7, wherein the first and second transistors are bipolar transistors of the NPN and PNP type respectively.

12. Resonant driving system for driving a fluorescent lamp having at least one end connected to a primary winding of a transformer, the resonant driving system comprising:

a filter;

a diode bridge circuit connected to the filter;

an inductor inserted between the diode bridge circuit and an internal circuit node, in turn connected to another end of the fluorescent lamp;

a converter inserted between the internal node and a voltage reference and comprising a first and a second transistors of the complementary type, inserted, in series to each other, between the internal node and the voltage reference and having the control terminals connected to the control circuit; and a control circuit connected to a secondary winding of the transformer and to the converter as well as to the control terminals of the first and second transistors of the converter and comprising an inductor connected to a resistor, in turn connected to the control terminals of the first and second transistors respectively through a first and a second capacitor as well as a capacitor connected between the inductor and a further internal node defined as the interconnection point between the first and second transistors.

13. Resonant driving system of claim 12, wherein the secondary winding of the transformer is connected a further internal node defined as the interconnection point between the first and second transistors.

14. Resonant driving system of claim 12, further comprising a first resistor connected between the control terminal of the first transistor and the internal circuit node and a second resistor connected between the control terminals of the first and second transistors.

15. Resonant driving system of claim 12, further comprising a snubber circuit connected at the output of the converter between the primary winding of the transformer and the voltage reference, the snubber circuit comprising a capacitor and a resistor connected in parallel to each other between the primary winding of the transformer and the voltage reference.

16. Resonant driving system of claim 12, wherein the first and second transistors are bipolar transistors of the NPN and PNP type respectively.

17. Resonant driving system for driving a fluorescent lamp having at least one end connected to a primary winding of a transformer, the resonant driving system comprising:

a filter;

a diode bridge circuit connected to the filter;

an inductor inserted between the diode bridge circuit and an internal circuit node, in turn connected to another end of the fluorescent lamp;

a converter inserted between the internal node and a voltage reference and comprising a first and a second transistors of the complementary type, inserted, in series to each other, between the internal node and the voltage reference and having the control terminals connected to the control circuit;

a snubber circuit connected at the output of the converter between the primary winding of the transformer and the voltage reference comprising a capacitor and a resistor connected in parallel to each other between the primary winding of the transformer and the voltage reference; and a control circuit connected to a secondary winding of the transformer and to the converter and comprising an inductor connected to a resistor, in turn connected to the control terminals of the first and second transistors respectively through a first and a second capacitor as well as a capacitor connected between the inductor and a further internal node defined as the interconnection point between the first and second transistors.

18. Resonant driving system of claim 17, wherein the secondary winding of the transformer is connected a further internal node defined as the interconnection point between the first and second transistors.

19. Resonant driving system of claim 17, further comprising a first resistor connected between the control terminal of the first transistor and the internal circuit node and a second resistor connected between-the control terminals of the first and second transistors.

20. Resonant driving system of claim 17, wherein the first and second transistors are bipolar transistors of the NPN and PNP type respectively.

21. A circuit for driving a fluorescent lamp, the circuit comprising:

first and second supply nodes;

first and second lamp nodes for coupling to the lamp;

a ballast inductor coupled to the first supply node and to the first lamp node;

a first transistor having a control node, a first drive terminal coupled to the first lamp node, and a second drive terminal coupled to the second lamp node;

a second transistor having a control node, a first drive terminal coupled to the second lamp node, and a second drive terminal coupled to the second supply node;

a first generator operable to generate a first bias voltage at the control node of the first transistor;

a second generator operable to generate a second bias voltage at the control node of the second transistor; and a third generator operable to generate a first nonzero-frequency drive voltage at the control node of the first transistor and a second nonzero-frequency drive voltage at the control node of the second transistor.

22. The circuit of claim 21, wherein:

the first transistor comprises an npn transistor; and the second transistor comprises a pnp transistor.

23. The circuit of claim 21 wherein:

the first generator comprises a first capacitor coupled between the third generator and the control node of the first transistor; and the second generator comprises a second capacitor coupled between the third generator and the control node of the second transistor.

24. The circuit of claim 21, further comprising:

a first winding of a transformer coupled to one of the first and second lamp nodes; and wherein the third generator comprises, a second winding of the transformer having a first node coupled to the second lamp node and having a second node, an inductor having a first node coupled to the second node of the second winding and having a second node coupled to the control nodes of the first and second transistors, and a capacitor having a first node coupled to the control nodes of the first and second transistors and having a second node coupled to the second lamp node.

25. The circuit of claim 21, further comprising a power supply coupled to the first and second supply terminals.

26. A method, comprising:

driving a current through a fluorescent lamp in a first direction with a first transistor while a second transistor is inactive;

deactivating the first transistor such that both the first and second transistors are inactive for a first period having a first predetermined duration; and after the first period has elapsed, driving a current through the fluorescent lamp in a second direction with the second transistor while the first transistor is inactive.

27. The method of claim 26, further comprising allowing the lamp to draw a current during the first period while the first and second transistors are inactive.

28. The method of claim 26, further comprising deactivating the second transistor such that both the first and second transistors are inactive for a second period having a second predetermined duration.

29. The method of claim 26, further comprising deactivating the second transistor such that both the first and second transistors are inactive for a second period having the first predetermined duration.

* * * * *

UNITED STATES PATENT AND TRADEMARK OFFICE

CERTIFICATE OF CORRECTION

PATENT NO. : 6,628,090 B1
DATED : September 30, 2003
INVENTOR(S) : Rosario Scollo It is certified that error appears in the above-identified patent and that said Letters Patent is hereby corrected as shown below:

Column 12,
Line 36, please delete the hyphen "-" in between the words "between" and "the" and insert a space.

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,628,090 B1
DATED : September 30, 2003
INVENTOR(S) : Rosario Scollo It is certified that error appears in the above-identified patent and that said Letters Patent is hereby corrected as shown below:

Column 6,
Line 39, “11” should be -- I1 --.
Line 40, after “terminal”, “12” should be -- I2 --.
Line 50, “electrolithic” should be -- electrolytic --.

Signed and Sealed this

Twentieth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,628,090 B1 
APPLICATION NO. : 10/161060
DATED : September 30, 2003
INVENTOR(S) : Scollo It is certified that error appears in the above-identified patent and that said Letters Patent is hereby corrected as shown below:

Delete Title page illustrating figure, and substitute therefor, new Title page illustrating figure. (attached)

Delete drawing sheets 1-13, and substitute therefor, drawing sheets 1-13, with the attached sheets.

Signed and Sealed this

Tenth Day of October, 2006

JON W. DUDAS
*Director of the United States Patent and Trademark Office*

(12) United States Patent
Scollo

(10) Patent No.: US 6,628,090 B1
(45) Date of Patent: Sep. 30, 2003

(54) RESONANT DRIVING SYSTEM FOR A FLUORESCENT LAMP

(75) Inventor: Rosario Scollo, Misterbianco (IT)

(73) Assignee: STMicroelectronics, S.r.l., Agrate Brianza (IT)

( * ) Notice: Subject to any disclaimer, the term of this patent is extended or adjusted under 35 U.S.C. 154(b) by 0 days.

(21) Appl. No.: 10/161,060

(22) Filed: May 31, 2002

(51) Int. Cl.[7] ..... H05B 37/02

(52) U.S. Cl. ..... 315/224; 315/209 R; 315/276; 315/291; 315/DIG. 5

(58) Field of Search ..... 315/224, 209 R, 315/219, 225, 200 R, 246, 274, 276–279, 291, DIG. 2, DIG. 4, DIG. 7

(56) References Cited

U.S. PATENT DOCUMENTS 5,349,270 A * 9/1994 Roll et al. ..... 315/209 R
5,864,211 A * 1/1999 Kiermeier ..... 315/127
5,917,289 A 6/1999 Nerone et al. ..... 315/209 R
5,925,984 A * 7/1999 Fischer et al. ..... 315/219
5,962,985 A * 10/1999 Buij et al. ..... 315/224
5,965,985 A 10/1999 Nerone ..... 315/DIG. 4
5,982,108 A * 11/1999 Buij et al. ..... 315/209 R
6,018,220 A 1/2000 Nerone ..... 315/219

* cited by examiner

*Primary Examiner*—Don Wong
*Assistant Examiner*—Tuyet T. Vo
(74) *Attorney, Agent, or Firm*—Graybeal Jackson Haley LLP

(57) ABSTRACT

A resonant driving system for a fluorescent lamp having one end connected to a primary winding of a transformer. The driving system includes an inductor inserted between an input section of the resonant driving system and an internal circuit node that is connected to another end of the fluorescent lamp a converter inserted between the internal node and a voltage reference and comprising a first transistor and a second transistor of the complementary type, inserted, in series to each other, between the internal node and the voltage reference, and a control circuit connected to a secondary winding of the transformer and to the converter as well as to the control terminals of the first and second transistors of the converter, wherein the control circuit comprises an inductor connected to a resistor that is connected to the control terminals of the first and second transistors through a first and a second capacitor respectively.

29 Claims, 12 Drawing Sheets

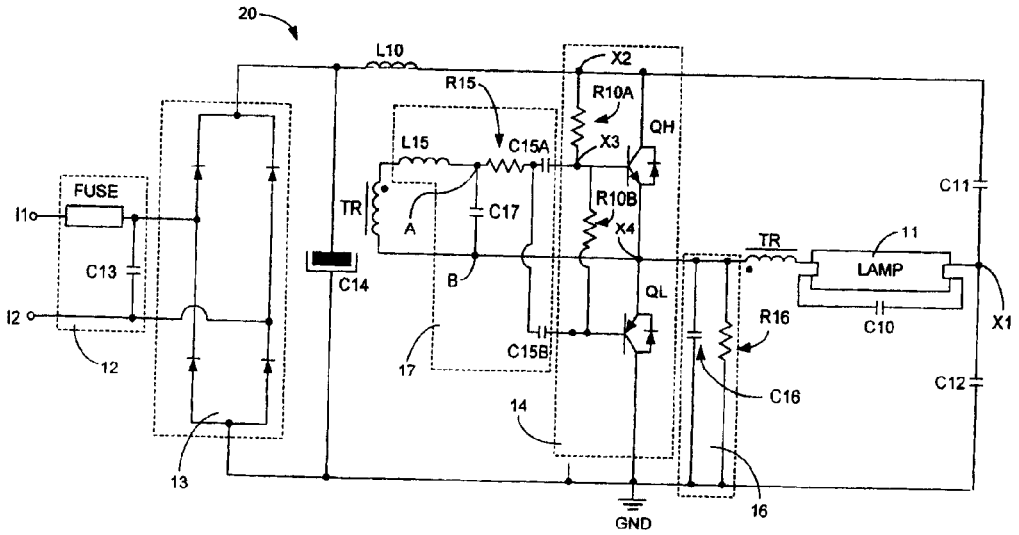

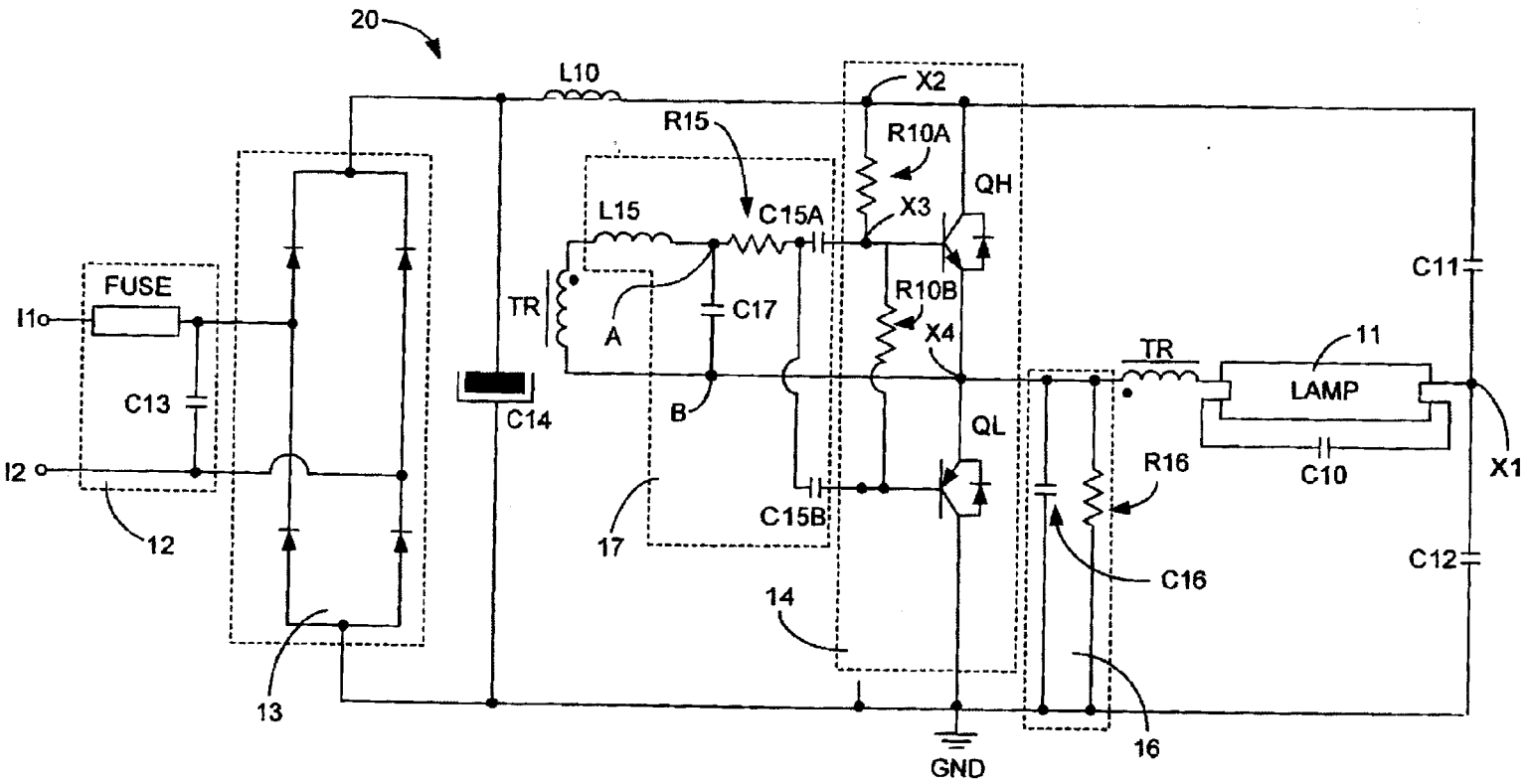
FIG. 8 (Amended)

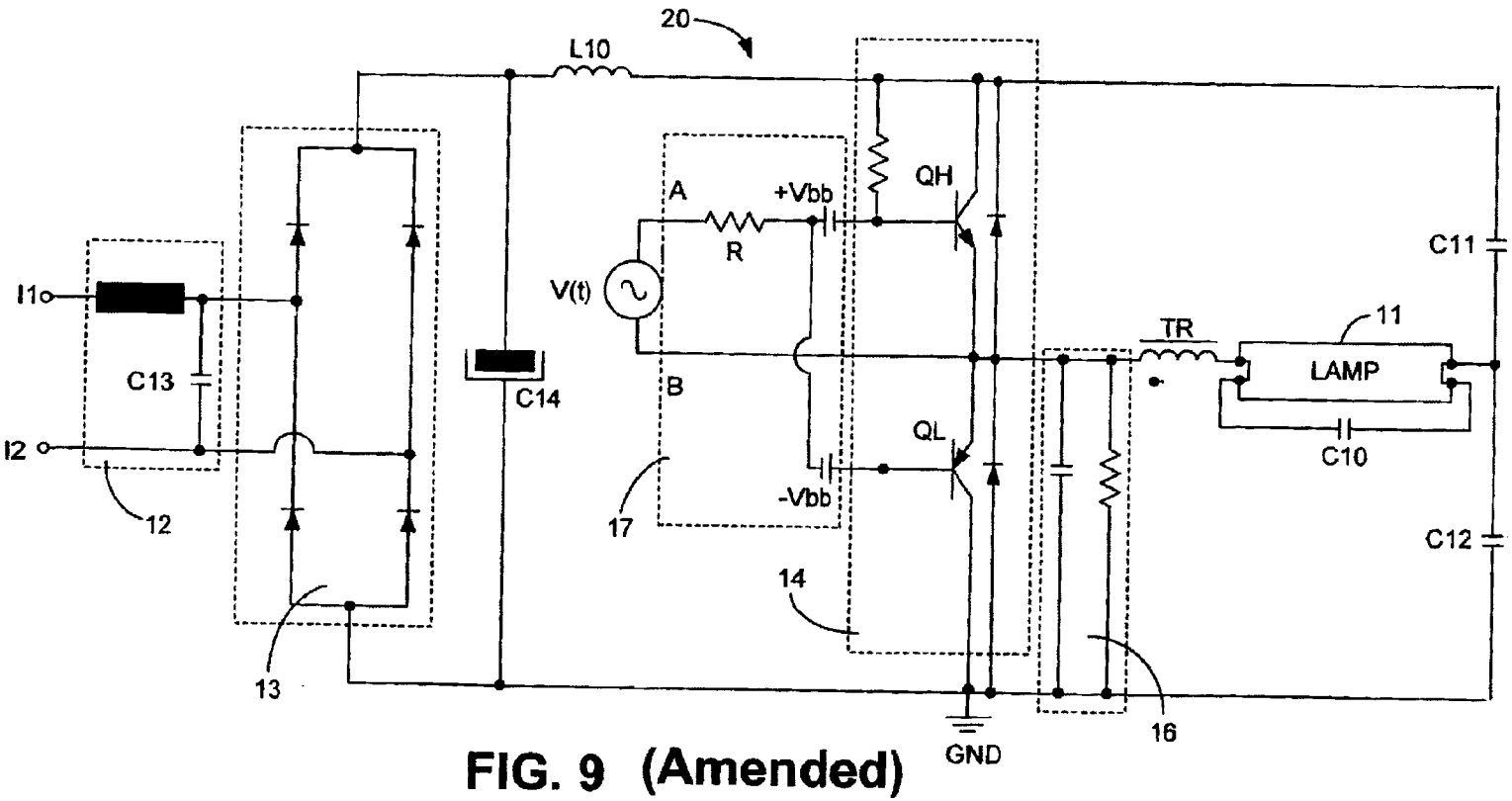
FIG. 9 (Amended)